US009531088B2

(12) United States Patent
Kihara et al.

(10) Patent No.: US 9,531,088 B2
(45) Date of Patent: Dec. 27, 2016

(54) CRIMP TERMINAL, CONNECTION STRUCTURAL BODY, AND METHOD OF MANUFACTURING CONNECTION STRUCTURAL BODY

(71) Applicants: FURUKAWA ELECTRIC CO., LTD., Tokyo (JP); FURUKAWA AUTOMOTIVE SYSTEMS INC., Inukami-gun (JP)

(72) Inventors: Yasushi Kihara, Tokyo (JP); Akira Tachibana, Tokyo (JP); Saburo Yagi, Tokyo (JP); Yukihiro Kawamura, Inukami-gun (JP); Takashi Tonoike, Inukami-gun (JP)

(73) Assignees: Furukawa Electric Co., Ltd., Tokyo (JP); Furukawa Automotive Systems, Inc., Inukami-gun (JP)

( * ) Notice: Subject to any disclaimer, the term of this patent is extended or adjusted under 35 U.S.C. 154(b) by 0 days.

(21) Appl. No.: 14/807,403

(22) Filed: Jul. 23, 2015

(65) Prior Publication Data

US 2015/0333416 A1 Nov. 19, 2015

Related U.S. Application Data

(63) Continuation of application No. PCT/JP2014/050593, filed on Jan. 15, 2014.

(30) Foreign Application Priority Data

Feb. 20, 2013 (JP) ..... 2013-030865

(51) Int. Cl.
*H01R 4/10* (2006.01)
*H01R 4/18* (2006.01)
(Continued)

(52) U.S. Cl.
CPC ..... *H01R 4/187* (2013.01); *H01R 4/16* (2013.01); *H01R 4/20* (2013.01); *H01R 13/113* (2013.01);
(Continued)

(58) Field of Classification Search
CPC ..... H01R 4/185; H01R 4/188; H01R 43/048
(Continued)

(56) References Cited

U.S. PATENT DOCUMENTS

2012/0329343 A1* 12/2012 Sato ..... H01R 4/185 439/866
2013/0040509 A1 2/2013 Mitose et al.
(Continued)

FOREIGN PATENT DOCUMENTS

CN 102742083 A 10/2012
JP 63-250082 A 10/1988
(Continued)

OTHER PUBLICATIONS

International Search Report for PCT/JP2014/050593 dated Apr. 22, 2014.
(Continued)

*Primary Examiner* — Abdullah Riyami
*Assistant Examiner* — Nader Alhawamdeh
(74) *Attorney, Agent, or Firm* — Oblon, McClelland, Maier & Neustadt, L.L.P.

(57) ABSTRACT

A barrel portion which allows the pressure-bonding connection of an aluminum core wire exposed on a distal end of an insulated wire covered with an insulating cover is formed into a cylindrical shape by bending barrel portion corresponding portions of a terminal base material in a terminal developed state about a terminal axis. In abutting end portions where the barrel portion corresponding portions abut each other, a welded part which welds the end portions
(Continued)

is formed along a long length direction of the insulated wire. The welded part is formed on an upper surface concave portion and a projecting portion where an amount of plastic deformation of a conductor pressure-bonding section generated along with the pressure-bonding of the conductor pressure-bonding section becomes larger compared to other portions in a circumferential direction of the conductor pressure-bonding section.

17 Claims, 14 Drawing Sheets

(51) Int. Cl.

| | |
|---|---|
| ***H01R 4/16*** | (2006.01) |
| ***H01R 43/048*** | (2006.01) |
| ***H01R 4/20*** | (2006.01) |
| ***H01R 13/11*** | (2006.01) |
| *H01R 4/62* | (2006.01) |

(52) U.S. Cl.
CPC ..... *H01R 43/048* (2013.01); *H01R 4/62* (2013.01); *Y10T 29/49183* (2015.01)

(58) Field of Classification Search
USPC ..... 439/877
See application file for complete search history.

(56) References Cited

U.S. PATENT DOCUMENTS

2015/0349436 A1* 12/2015 Torigoshi ..... H01R 4/185 439/877
2015/0357724 A1* 12/2015 Okuno ..... C25D 7/00 439/877
2015/0357725 A1* 12/2015 Matsuo ..... C22C 9/00 439/877
2015/0364833 A1* 12/2015 Tonoike ..... H01R 4/183 439/879
2015/0364835 A1* 12/2015 Tonoike ..... H01R 43/0488 439/879
2015/0364836 A1* 12/2015 Yagi ..... B23K 26/32 439/877
2015/0364837 A1* 12/2015 Yagi ..... H01R 4/187 439/879
2016/0006135 A1* 1/2016 Terashima ..... H01R 4/183 174/72 A
2016/0013567 A1* 1/2016 Sakaguchi ..... H01R 4/185 439/877
2016/0028167 A1* 1/2016 Hanazaki ..... H01R 4/184 439/877
2016/0087350 A1* 3/2016 Yamaji ..... H01R 4/18 439/877
2016/0099507 A1* 4/2016 Tachibana ..... H01R 43/048 439/877

FOREIGN PATENT DOCUMENTS

| | | | |
|---|---|---|---|
| JP | 1-89467 | U | 6/1989 |
| JP | H01-89467 | | 6/1989 |
| JP | 07-147176 | A | 6/1995 |
| JP | 7-147176 | A | 6/1995 |
| JP | 07-226281 | A | 8/1995 |
| JP | 7-226281 | A | 8/1995 |
| JP | 07-226282 | A | 8/1995 |
| JP | 7-226282 | A | 8/1995 |
| JP | 07-226283 | A | 8/1995 |
| JP | 7-226283 | A | 8/1995 |
| JP | 2004-071437 | A | 3/2004 |
| JP | 2004-71437 | A | 3/2004 |
| JP | 2011-233273 | | 11/2011 |
| JP | 2012-022928 | A | 2/2012 |
| JP | 2012-22928 | A | 2/2012 |
| JP | 2013-062204 | A | 4/2013 |
| JP | 2013-62204 | A | 4/2013 |
| WO | WO 2014/017660 | A1 | 1/2014 |

OTHER PUBLICATIONS

Office Action drafted Apr. 14, 2014 in Japanese Patent Application No. 2014-506651 (with unedited computer generated English translation).
Office Action issued Nov. 26, 2014 in Korean Patent Application No. 10-2014-7031222 (with English language translation).
Combined Office Action and Search Report issued Jul. 2, 2015 in Chinese Patent Application No. 201480001314.1 (with English language translation).
Office Action issued Nov. 18, 2015 in Chinese Patent Application No. 201480001314.1(with English language translation).
Chinese Notice of Decision to Grant a Patent issued Feb. 3, 2016 in Patent Application No. 201480001314.1 (with English Translation).

* cited by examiner

CRIMP TERMINAL, CONNECTION STRUCTURAL BODY, AND METHOD OF MANUFACTURING CONNECTION STRUCTURAL BODY

CROSS-REFERENCE TO RELATED APPLICATIONS

This application is a continuation application of PCT International Application No. PCT/JP2014/050593 filed Jan. 15, 2014, which claims priority to Japanese Application No. 2013-030865 filed Feb. 20, 2013, both of which are herein incorporated by reference in their entirety for all purposes.

TECHNICAL FIELD

The present invention relates to, for example, a crimp terminal, a connection structural body which is mounted on a connector of a wire harness for an automobile or the like, and a method of manufacturing a connection structural body.

BACKGROUND ART

An electric apparatus mounted on an automobile or the like forms an electric circuit by connecting such an electric apparatus with another electric apparatus or a power source device through a wire harness which is formed by binding insulated wires. In this case, the wire harness is connected with the electric apparatus or the power source device by connecting connectors which are mounted on these components.

With respect to these connectors, a crimp terminal which is connected to the insulated wire by pressure-bonding is incorporated in the inside of the connector. A female connector and a male connector which are connected in the concave and convex relationship are configured to be engaged with each other by fitting engagement.

Such connectors are used under various environments and hence, there may be a case where unintended moisture adheres to a surface of the insulated wire due to condensation brought about by a change in ambient temperature or the like. There is a drawback that, when moisture intrudes into the inside of the connector along the surface of the insulated wire, a surface of a wire conductor exposed from a distal end of the insulated wire corrodes.

In view of the drawback, there have been proposed various techniques for preventing the intrusion of moisture into a wire conductor pressure-bonded using a crimp terminal.

For example, a conductive member disclosed in Patent Document 1 is also one of such crimp terminals. The "conductive member" disclosed in Patent Document 1 is formed of a fastening portion which is a base member on which a connecting surface to be connected to other member is formed, and a wire connection portion which projects toward the fastening portion and to which a tip end portion of a wire is connected.

The wire connection portion has an insertion hole into which the tip end portion of the wire can be inserted, and is formed into a cylindrical shape having an opening on a distal end side thereof in the projecting direction. The wire is connected to the "conductive member" disclosed in Patent Document 1 such that a conductor tip which is formed by peeling off an insulating cover on a tip portion side of the wire is inserted into the insertion hole of the wire connection portion, and the wire connection portion is fastened by caulking in such a state thus connecting the wire to the conductive member by pressure-bonding.

However, the wire connection portion of the "conductive member" disclosed in Patent Document 1 is of a so-called closed barrel type and has a cylindrical shape. The closed-barrel-type wire connection portion has higher rigidity than a so-called open-barrel-type wire connection portion where a portion of the open-barrel-type wire connection portion in the circumferential direction is opened, and there also exists a possibility that, the wire connection portion is hardened by working in forming the wire connection portion.

Accordingly, when the wire connection portion in a state where the conductor tip is inserted into the wire connection portion is fastened (pressure-bonded) by caulking using a jig such as a pressure-bonding blade die (crimper) or the like, ductility is lowered by work hardening thus giving rise to a state where a portion of the wire connection portion in the circumferential direction is plastically deformed with a larger amount of bending deformation or with a larger amount of displacement compared to other portions of the wire connection portion. There arises a possibility that cracks are generated on the wire connection portion or the whole wire connection portion cannot be compressed uniformly along with such plastic deformation. Accordingly, there exists a possibility that the water-blocking performance cannot be ensured against the intrusion of moisture into the inside of the wire connection portion or conductivity between the conductor tip and the wire connection portion cannot be ensured in a stable manner.

PRIOR ART DOCUMENT

Patent Document

Patent Document 1: Japanese Patent Laid-open Publication No. 2011-233273

SUMMARY OF THE INVENTION

Problems to be Solved by the Invention

Accordingly, it is an object of this invention to provide a crimp terminal, a connection structural body and a method of manufacturing a connection structural body by which an annealing effect is acquired that a strain generated in the inside of a pressure-bonding section by work hardening can be eliminated, thus the followability to a pressure-bonding blade die can be enhanced so that the generation of pressure-bonding cracks at the time of pressure-bonding can be avoided, and the pressure-bonding resistance can be made stable.

Solutions to the Problems

This invention is directed to a crimp terminal provided with a pressure-bonding section which allows the pressure-bonding connection of at least a conductor tip of an insulated wire formed by covering a conductor with an insulating cover and having the conductor tip where the conductor is exposed by peeling off the insulating cover at least on a distal end side, wherein the pressure-bonding section is configured such that portions of a terminal base material in a terminal developed shape corresponding to the pressure-bonding section are formed into a cylindrical shape by bending the portions about a terminal axis, abutting end portions are formed by abutting the portions of the terminal base material corresponding to the pressure-bonding section, and a welded part where the abutting end portions are welded to each other is formed along a long length direction of the pressure-bonding section, and the welded part is formed in a plastic deformation portion where an amount of plastic deformation of the pressure-bonding section generated along with pressure-bonding of the pressure-bonding section applied to the conductor tip of the pressure-bonding section is relatively large compared to an amount of plastic deformation of a peripheral portion of the pressure-bonding section in a circumferential direction.

A means for forming the welded part at the abutting end portions may be, for example, gas welding, electric resistance welding, laser welding or the like. However, such a means is not particularly limited. That is, such a means is not particularly limited provided that the means can supply heat for annealing the abutting end portions.

The plastic deformation portion is not limited to a portion which exhibits the largest amount of deformation in the circumferential direction of the pressure-bonding section, and may be a portion where an amount of deformation is locally increased compared to a peripheral portion in the circumferential direction of the pressure-bonding section.

The amount of deformation indicates the degree of change in shape of the pressure-bonding section in a post-pressure-bonding state compared to a shape of the pressure-bonding section in a pre-pressure-bonding state, and indicates at least any one of a compression amount, an elongation amount (tensile amount), a bending amount and an amount of displacement (movement amount). That is, the plastic deformation of the pressure-bonding section is satisfied when a change in shape brings about the plastic deformation. The plastic deformation of the pressure-bonding section is not limited to the plastic deformation where a predetermined portion of the pressure-bonding section is deformed by bending in the circumferential direction of the pressure-bonding and, for example, the plastic deformation of the pressure-bonding section includes a case where the shape of the pressure-bonding section changes due to displacement caused by compression or tension.

The conductor may be a stranded wire formed by stranding raw wires or a single wire and, further, the conductor may be formed as an aluminum-based conductor made of aluminum or an aluminum alloy, for example. That is, the conductor may be made of a metal different from a metal for forming a crimp terminal, for example, a less noble metal with respect to a metal for forming the crimp terminal. However, a material for forming the conductor is not limited to such a material, and the conductor may be made of the same type of metal as the crimp terminal by forming the conductor using a copper-based conductor made of copper or a copper alloy.

According to this invention, for example, the terminal is formed through cold working such as a blanking step of blanking the terminal having a developed terminal shape from a base material, a bending step of bending portions of the blanked terminal corresponding to the pressure-bonding section in a cylindrical shape and is subjected to work hardening by the above-mentioned cold working and hence, hardness of the terminal is several times as large as hardness of the terminal base material before the cold working.

On the other hand, to the plastic deformation portion where an amount of deformation of the pressure-bonding section is large, particularly large stress is applied when the conductor tip is pressure-bonded.

As a result, as a plastic deformation is generated at the time that the plastic deformation portion which is hardened by working pressure-bonds the pressure-bonding section and the conductor tip thus giving rise to the generation of cracks particularly in the plastic deformation portion.

In contrast, by welding the abutting end portions of the pressure-bonding section, the pressure-bonding section is annealed by heat generated by welding in the circumferential direction about the welded part. Accordingly, strain (dislocation) attributed to work hardening generated along with working in a pre-pressure-bonding state such as bending can be removed not only from a portion of the pressure-bonding section corresponding to the welded part but also non-welded portions of the pressure-bonding section other than the portion corresponding to the welded part.

Particularly, the welded part is formed on the plastic deformation portion in the circumferential direction of the pressure-bonding section, and hence, particularly the plastic deformation portion where the welded part is formed in the pressure-bonding section which is hardened by working at the time of forming through cold working can acquire an excellent annealing effect.

Accordingly, the strain particularly in the plastic deformation portion where the welded part is formed in the pressure-bonding section can be surely eliminated so that hardness can be sufficiently lowered whereby excellent ductility can be acquired.

Accordingly, at the time of pressure-bonding the pressure-bonding section to the conductor tip, the plastic deformation portion can be surely plastically deformed.

On the other hand particularly by forming the plastic deformation portion in the portion other than the welded part in the circumferential direction of the pressure-bonding section, at the time of forming the welded part, heat applied to the abutting end portions is transferred to the plastic deformation portion and hence, an annealing effect can be also acquired with respect to the plastic deformation portion formed on the portions other than the welded part.

Accordingly, also in the plastic deformation portion formed on the portion other than a welded part, the plastic deformation can be obtained without generating cracks due to the compression caused by pressure-bonding. Further, unlike the abutting end portions, heat is not directly applied to the non-welded part other than the welded part at the time of performing welding and hence, an annealing temperature of the non-welded part can be suppressed compared to an annealing temperature for the welded part whereby a proper annealing effect can be acquired.

That is, the plastic deformation portion formed on the portion other than the welded part can acquire an annealing effect so that the plastic deformation portion obtains proper hardness to have strength which prevents the generation of cracks at the time of pressure-bonding.

According to one mode of this invention, the pressure-bonding section may be formed such that, on an orthogonal cross section which orthogonally intersects with the long length direction, both sides with respect to an imaginary axis of the pressure-bonding section are formed into a symmetrical shape, the imaginary axis which connects a center portion of the orthogonal cross section and the welded part linearly, and the plastic deformation portion may be formed on both sides of the imaginary axis in the circumferential direction of the pressure-bonding section.

Due to the above-mentioned constitution, heat which is applied along with welding of the abutting end portions at the time of forming the welded part is transferred to the plastic deformation portions formed on both sides of the imaginary axis in the circumferential direction of the pressure-bonding section and hence, an annealing effect can be acquired also with respect to the plastic deformation portions which are portions other than the welded part.

Particularly, with respect to the plastic deformation portions formed on both sides of the imaginary axis in the circumferential direction of the pressure-bonding section, an annealing temperature of such plastic deformation portions is low compared to an annealing temperature of the plastic deformation portion where the welded part is formed and hence, it is possible to acquire an annealing effect so as to obtain proper hardness to have strength which prevents the generation of cracks at the time of pressure-bonding.

Accordingly, in the same manner as the plastic deformation portion where the welded part is formed, also in the plastic deformation portions formed on both sides of the imaginary axis in the circumferential direction of the pressure-bonding section, the pressure-bonding section can be plastically deformed without causing cracks along with pressure-bonding.

Further, as described previously, by forming the pressure-bonding section such that the orthogonal cross section in a post-pressure-bonding state becomes symmetrical on both sides of the imaginary axis which passes the welded part, at the time of pressure-bonding the pressure-bonding section to the conductor tip, it is also possible to plastically deform the welded part without causing cracks or the like.

This will be described in more detail. By forming the pressure-bonding section such that the orthogonal cross section of the pressure-bonding section in a post-pressure-bonding state becomes symmetrical on both sides of the imaginary axis which passes the welded part, at the time of pressure-bonding the pressure-bonding section to the conductor tip, a stress applied to the pressure-bonding section can be uniformly applied to both sides of the welded part and hence, it is possible to prevent the generation of cracks in the welded part eventually.

According to one mode of this invention, the amount of plastic deformation of the pressure-bonding section may be set to an amount of displacement that the pressure-bonding section is displaced along with the plastic deformation of the pressure-bonding section, and the plastic deformation portion where the welded part is formed may be formed as a plastic displacement portion where the amount of displacement is large compared to an amount of displacement of the peripheral portion.

Due to the above-mentioned constitution, the welded part is formed in the plastic displacement portion. Accordingly, by welding the abutting end portions, it is possible to surely anneal the plastic displacement portion where ductility is lowered by work hardening brought about by steps in a pre-pressure-bonding state such as bending the pressure-bonding section into a cylindrical shape, or the like, for example.

Accordingly, the plastic displacement portion can acquire the excellent ductility. Although the plastic displacement portion is largely displaced compared to the peripheral portion along with compression at the time of pressure-bonding the pressure-bonding section, it is possible to surely deform the pressure-bonding section without causing cracks or the like in the plastic displacement portion.

Further, the welded part can acquire an annealing effect by welding the abutting end portions and hence, hardness of the pressure-bonding section can be sufficiently lowered.

Such a welded part is formed in the portion where an amount of displacement becomes relatively large compared to an amount of displacement of the peripheral portion while an amount of deformation by bending becomes relatively small compared to an amount of deformation by bending of the peripheral portion, that is, in the above-mentioned plastic deformation portion. Accordingly, there is no possibility that the bending deformation which applies a large stress is forcibly applied to the welded part along with pressure-bonding of the pressure-bonding section to the conductor tip and hence, even when hardness of the pressure-bonding section is sufficiently lowered by the welded part, no cracks is generated so that the pressure-bonding section can be surely plastically deformed.

This will be described in more detail. In largely plastically deforming the predetermined portion in the circumferential direction of the pressure-bonding section compared to the peripheral portion of the predetermined portion, when the plastic bending deformation is performed, a load applied to the predetermined portion is increased so that the predetermined portion is liable to rupture compared to the case where the plastic displacement is performed.

That is, it is safe to say that, compared to the plastic deformation, the plastic bending deformation is the plastic deformation where a predetermined portion in the circumferential direction of the pressure-bonding section is liable to rupture at the time of pressure-bonding the pressure-bonding section to the conductor tip.

Accordingly, by forming the welded part in the plastic displacement portion but not in the plastic bending deformation portion, even when the hardness of the welded part becomes lower than desired hardness due to a sufficient annealing effect acquired by forming the welded part to the abutting end portions, at the time of pressure-bonding the pressure-bonding section to the conductor tip, the plastic deformation can be surely performed without rupturing the welded part.

According to one mode of this invention, the amount of plastic deformation of the pressure-bonding section may be set to an amount of deformation by bending that the pressure-bonding section is deformed by bending along with the plastic deformation of the pressure-bonding section, and the plastic deformation portion formed on the both sides of the imaginary axis in the circumferential direction of the pressure-bonding section may be formed as a plastic bending deformation portion where the amount of deformation by bending is large compared to an amount of deformation by bending of the peripheral portion.

Due to the above-mentioned constitution, by arranging the plastic bending deformation portion at the portions other than the welded part in the circumferential direction of the pressure-bonding section, heat is not directly applied to the plastic bending deformation portion at the time of welding the abutting end portions and hence, the plastic bending deformation portion can be annealed at an annealing temperature lower than an annealing temperature of the welded part.

Accordingly, strain caused by work hardening can be eliminated. Further, the pressure-bonding section can maintain proper hardness at which the pressure-bonding section can have strength capable of preventing rupture of the pressure-bonding section at the time of pressure-bonding. That is, at the time of pressure-bonding, although the plastic bending deformation portion is forcibly subjected to large bending deformation compared to the peripheral portion, the plastic bending deformation portion can be sufficiently bent following a pressure-bonding blade die.

According to one mode of this invention, the pressure-bonding section is preferably formed such that the orthogonal cross section of the pressure-bonding section in a post-pressure-bonding state is formed into a U-shaped orthogonal cross section.

According to this invention, in a case of the pressure-bonding section where the orthogonal cross section is formed into a U-shape, in a front view of the orthogonal cross section of the pressure-bonding section, the above-mentioned plastic displacement portion where an upper portion is displaced in a recessed shape downwardly is formed on an intermediate portion of the pressure-bonding section in a width direction.

Accordingly, due to an annealing effect obtained by forming the welded part in the above-mentioned plastic displacement portion, a work strain of the plastic displacement portion can be eliminated whereby the plastic displacement portion can be surely plastically deformed with a large amount of deformation compared to the peripheral portion.

On the other hand, in a case of the pressure-bonding section where the orthogonal cross section is formed into a U-shape, in a front view of the orthogonal cross section of the pressure-bonding, the plastic bending deformation portion which is deformed by bending in an upwardly projecting manner is formed on both sides of the pressure-bonding section in the width direction.

Due to such a constitution, heat generated by heating the abutting end portions at the time of forming the welded part is transferred to the plastic bending deformation portion, and the plastic bending deformation portion can be annealed by the transferred heat.

Accordingly, a work strain in the plastic bending deformation portion can be eliminated and, at the same time, it is possible to surely deform the plastic bending deformation portion where an amount of deformation by bending is large compared to the peripheral portion and the pressure-bonding section can be formed into a U-shape in orthogonal cross section.

According to one mode of this invention, the pressure-bonding section is preferably formed such that the orthogonal cross section of the pressure-bonding section in a post-pressure-bonding state is formed into an H-shaped orthogonal cross section.

According to this invention, in a case of the pressure-bonding section where the orthogonal cross section is formed into an H-shape, in a front view of the orthogonal cross section of the pressure-bonding section, the above-mentioned plastic displacement portion is formed where the portion of the pressure-bonding section corresponding to the welded part in the circumferential direction, that is, an intermediate portion of the pressure-bonding section in the width direction is displaced in a recessed shape toward the inside in the thickness direction.

Accordingly, due to an annealing effect obtained by forming the welded part in the plastic displacement portion, a work strain of the plastic displacement portion can be eliminated whereby the plastic displacement portion can be surely plastically deformed with a large amount of deformation compared to the peripheral portion.

On the other hand, in a case of the pressure-bonding section where the orthogonal cross section is formed into an H-shape, in a front view of the orthogonal cross section of the pressure-bonding section, the plastic bending deformation portion which is deformed by bending in a projecting manner toward both sides in the thickness direction is formed on both outer sides of the pressure-bonding section in the width direction.

Due to such a constitution, heat generated by heating the abutting end portions at the time of forming the welded part is transferred to the plastic bending deformation portion, and the plastic bending deformation portion can be annealed by the transferred heat.

Accordingly, a work strain in the plastic bending deformation portion can be eliminated and, at the same time, it is possible to surely deform the plastic bending deformation portion where an amount of deformation by bending is large compared to the peripheral portion and the pressure-bonding section can be formed into an H-shape in orthogonal cross section.

According to one mode of this invention, the amount of plastic deformation of the pressure-bonding section may be set to an amount of deformation by bending that the pressure-bonding section is deformed by bending along with the plastic deformation of the pressure-bonding section, and the plastic deformation portion formed in the welded part may be formed as a plastic bending deformation portion where the amount of deformation by bending is large compared to the amount of deformation by bending of the peripheral portion.

Due to the above-mentioned constitution, the welded part is formed in the plastic bending deformation portion and hence, for example, it is possible to surely anneal the plastic deformation portion which is hardened by working by pre-pressure-bonding steps such as bending of the pressure-bonding section into a cylindrical shape.

Accordingly, even when the portion which corresponds to the plastic bending deformation portion is largely deformed by bending compared to the peripheral portion along with the compression of the pressure-bonding section, the plastic bending deformation portion can be surely deformed without generating cracks or the like.

According to one mode of this invention, the pressure-bonding section is preferably formed such that the orthogonal cross section of the pressure-bonding section in a post-pressure-bonding state is formed into a cruciform-shaped orthogonal cross section having projecting portions on upper and lower sides as well as on left and right sides.

When the orthogonal cross section of the pressure-bonding section in a post-pressure-bonding state is formed into a cruciform shape, in a front view of the orthogonal cross section of the pressure-bonding section, the projecting portions which project outwardly in the radial direction in the circumferential direction of the pressure-bonding section exhibit a large amount of deformation by bending compared to the peripheral portion and hence, the projecting portions are formed as the plastic bending deformation portion.

By forming the welded part in such a plastic bending deformation portion as described previously, even when the portion corresponding to the plastic bending deformation portion is largely deformed by bending compared to the peripheral portion along with the compression of the pressure-bonding section, cracks or the like are not generated and hence, the pressure-bonding section can be surely formed into the orthogonal cross section which has a cruciform shape.

The invention is also directed to a connection structural body where an insulated wire that is formed by covering a conductor with an insulating cover and has a conductor tip by exposing the conductor by peeling off the insulating cover on a distal end side by a predetermined length and a crimp terminal provided with a pressure-bonding section which allows the pressure-bonding connection of the conductor tip are connected to each other by pressure-bonding, wherein the crimp terminal is formed of the crimp terminal described above, and the pressure-bonding section and at least the conductor tip of the insulated wire are pressure-bonded to each other.

According to the present invention, the connection structural body can be formed by pressure-bonding the pressure-bonding section where work hardening of the plastic deformation portion is eliminated to the conductor tip. Accordingly, it is possible to acquire the connection structural body having excellent water-blocking performance and conductivity in a state where pressure-bonding cracks are not generated in the pressure-bonding section and the pressure-bonding section is surely brought into close contact with the conductor tip without a gap.

The invention is also directed to a wire harness including: a plurality of pressure-bonding connection structural bodies described above, and a connector housing which is capable of housing the crimp terminals of the connection structural bodies, wherein the crimp terminals are disposed in the inside of the connector housing.

The invention is also directed to a method of manufacturing a connection structural body including: forming a crimp terminal provided with a cylindrical pressure-bonding section by a method of manufacturing a crimp terminal including: a blanking step of forming a terminal base material by blanking a base material in a terminal developed shape; a bending step of forming the terminal base material into a cylindrical shape by bending portions of the terminal base material corresponding to the pressure-bonding section about a terminal axis; and a welding step of forming a welded part along a long length direction, the welded part for welding abutting end portions where the portions of the terminal base material corresponding to the pressure-bonding section abut to each other in a circumferential direction in this order; a wire insertion step of inserting at least a conductor tip into the pressure-bonding section in a pre-pressure-bonding state, the conductor tip formed by exposing a conductor by a predetermined length on a distal end side by peeling off an insulated cover of an insulating wire formed by covering the conductor with the insulating cover; and a pressure-bonding step of pressure-bonding the pressure-bonding section to at least the conductor tip, the wire insertion step and the pressure-bonding step performed in this order, thus connecting the crimp terminal and the insulated wire to each other by pressure-bonding, wherein in the bending step, bending is applied to the portions of the terminal base material corresponding to the pressure-bonding section such that the abutting end portions of the portions of the terminal base material corresponding to the pressure-bonding section are arranged at a plastic deformation portion where an amount of plastic deformation that the pressure-bonding section is plastically deformed along with the pressure-bonding of the pressure-bonding section to the conductor tip in the pressure-bonding step is large compared to a peripheral portion of the pressure-bonding section in the circumferential direction.

According to the present invention, although the terminal base material is hardened by working by applying cold working such as a blanking step or a bending step to the base material, bending is applied to the portions of the terminal base material corresponding to the pressure-bonding section in the bending step, and the welding step of forming the welded part which welds the abutting end portions to each other along the long length direction is performed such that the abutting end portions of the portions of the terminal base material corresponding to the pressure-bonding section are arranged in the plastic deformation portion where an amount of plastic deformation that the pressure-bonding section plastically deforms is increased compared to the peripheral portion in the circumferential direction of the pressure-bonding section in the pressure-bonding step applied to the pressure-bonding section after the cold working. Accordingly, by the method of manufacturing a connection structural body, there can be acquired an annealing effect that a strain in the pressure-bonding section which is hardened by working such as the above-mentioned cold working can be eliminated.

Accordingly, in the pressure-bonding step, the pressure-bonding section can enhance the followability to the pressure-bonding blade die, can avoid the generation of pressure-bonding cracks at the time of pressure-bonding, and can make the pressure-bonding resistance stable.

Accordingly, the pressure-bonding section can be surely pressure-bonded to the conductor tip in a close contact state with no gap therebetween and hence, the connection structural body can acquire the excellent water-blocking performance and the excellent conductivity.

According to one mode of this invention, welding of the abutting end portions in the welding step may be performed by fiber laser welding.

According to the present invention, it is possible to manufacture the crimp terminal which forms the pressure-bonding section having no gap and can surely prevent the intrusion of moisture into the inside of pressure-bonding section in a pressure-bonded state. This will be described in more detail. The fiber laser can set a focal point on an extremely small spot compared to other welding lasers and hence, the fiber laser can realize high-output laser welding and, at the same time, can continuously emit a laser beam.

Accordingly, in the welding step, the abutting end portions can be surely welded to each other and hence, even in a pressure-bonded state, the connection structural body can ensure sufficient water-blocking performance and, at the same time, can effectively eliminate work hardening remaining in the pressure-bonding section.

According to one mode of this invention, the pressure-bonding section may be constituted of a conductor pressure-bonding section which pressure-bonds the conductor tip, and a cover pressure-bonding section which pressure-bonds a cover tip arranged on a more proximal end side than the conductor tip on a wire distal end side, and the conductor pressure-bonding section and the cover pressure-bonding section may be simultaneously pressure-bonded in the pressure-bonding step.

According to this invention, in the pressure-bonding step, the conductor pressure-bonding section and the cover pressure-bonding section which have different outer diameters are simultaneously pressure-bonded and hence, a stepped portion is formed in a boundary portion between the conductor pressure-bonding section and the cover pressure-bonding section in the long length direction of the pressure-bonding section whereby the pressure-bonding section is largely plastically deformed.

Further, by performing the welding step to the abutting end portions in the circumferential direction of the pressure-bonding section, by an annealing effect, it is possible to eliminate the work hardening of the plastic deformation portion present in the circumferential direction of the pressure-bonding section in a pre-pressure-bonding state due to cold working such as a blanking step or a bending step.

Accordingly, in the pressure-bonding step performed thereafter, even when the conductor pressure-bonding section and the cover pressure-bonding section are simultaneously pressure-bonded to each other, the pressure-bonding section can enhance the followability to the pressure-bonding blade die, can avoid the generation of pressure-bonding cracks at the time of pressure-bonding, and can make the pressure-bonding resistance stable.

Accordingly, the pressure-bonding section can be surely pressure-bonded to the conductor tip in a close contact state with no gap therebetween and hence, the connection structural body can acquire the excellent water-blocking performance and the excellent conductivity.

Effects of the Invention

According to this invention, there are provided a crimp terminal, a connection structural body and a method of manufacturing a connection structural body by which an annealing effect is acquired that a strain generated in the inside of a pressure-bonding section by work hardening can be eliminated, thus the followability to a pressure-bonding blade die can be enhanced so that the generation of pressure-bonding cracks at the time of pressure-bonding can be avoided, and the pressure-bonding resistance can be made stable.

EMBODIMENTS OF THE INVENTION

One embodiment of the present invention is described hereinafter also by reference to the drawings.

First, a pressure-bonding connection structural body 1 according to this embodiment is described in detail by reference to FIGS. 1A and 1B to FIGS. 3A and 3B.

Figure 1A:
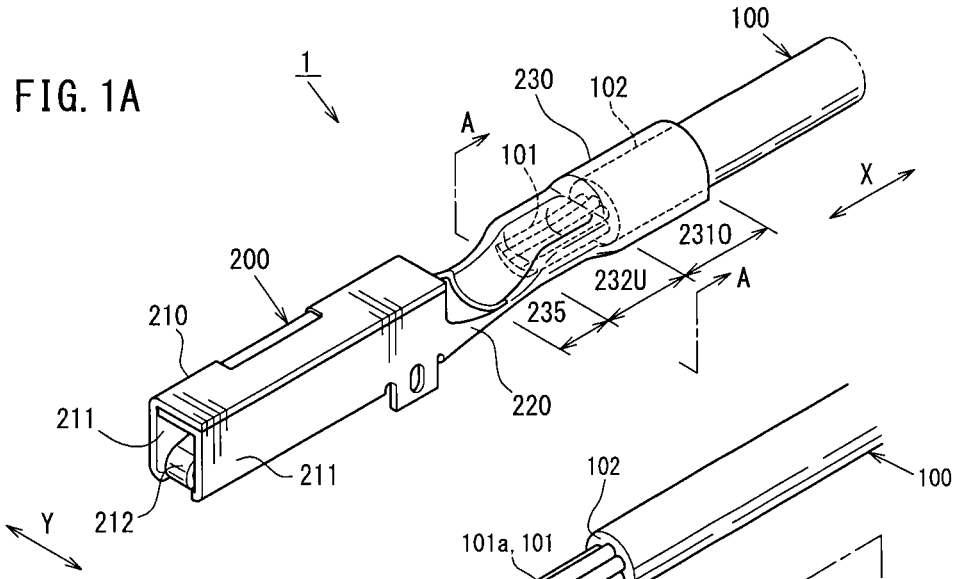
FIGS. 1A and 1B are explanatory views for describing a pressure-bonding connection structural body.
Figure 1B:
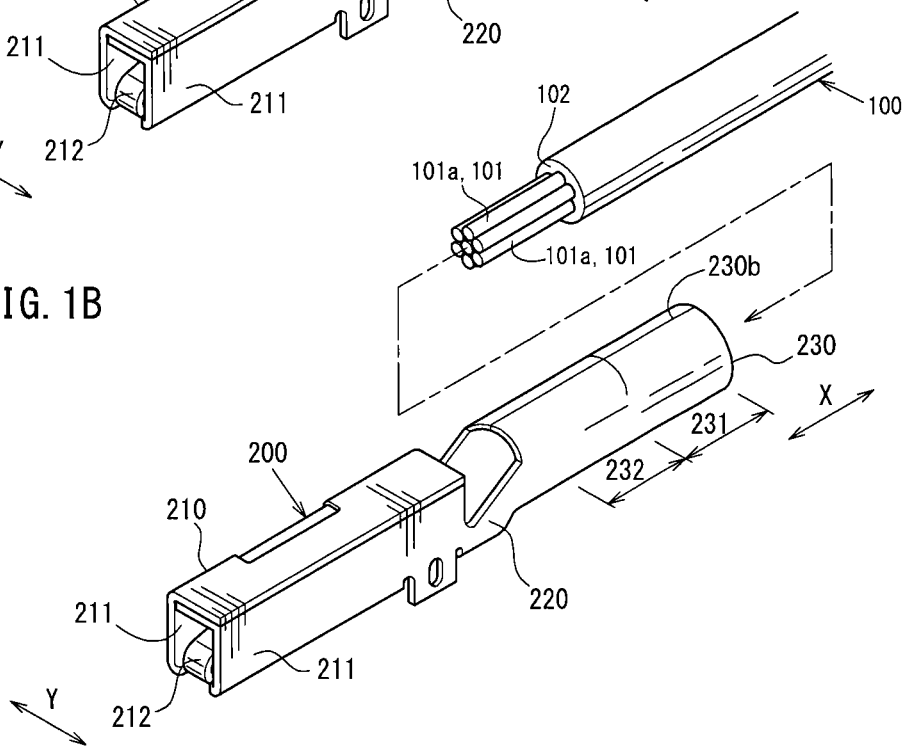
Figure 2:
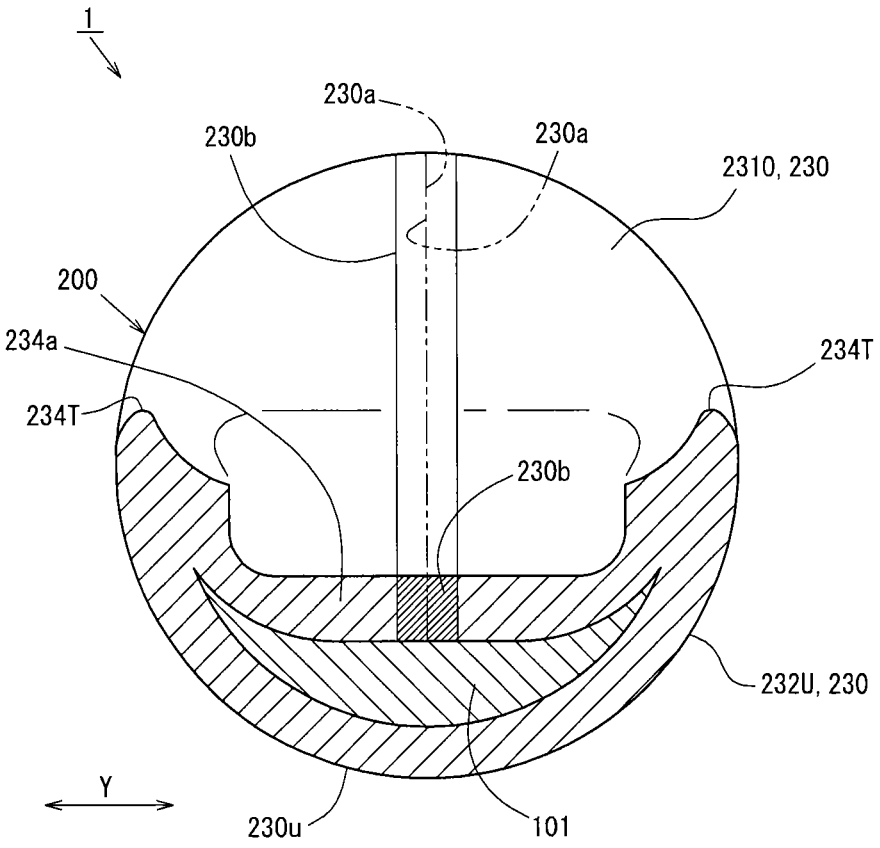
FIG. 2 is a cross-sectional view taken along line A-A in FIG. 1A.
Figure 3A:
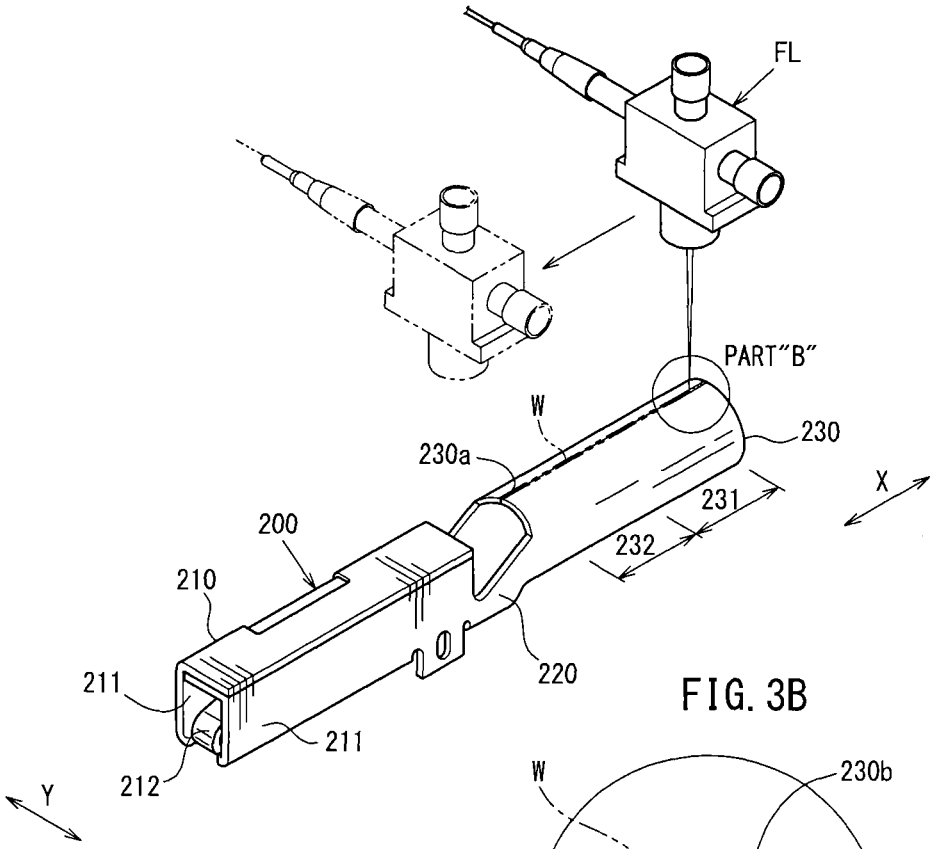
FIGS. 3A and 3B are explanatory views for describing welding on a barrel portion.
Figure 3B:
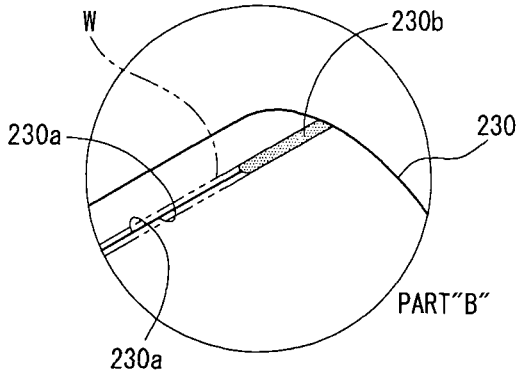

FIGS. 1A and 1B are explanatory views for describing the pressure-bonding connection structural body 1, FIG. 2 is a cross-sectional view taken along line A-A in FIG. 1A, and FIGS. 3A and 3B are explanatory views for describing welding on a barrel portion 230.

In FIGS. 1A and 1B, an arrow X indicates a long length direction (hereinafter referred to as "long length direction X") and an arrow Y indicates a width direction (hereinafter referred to as "width direction Y"). In the long length direction X, a side where a box section 210 described later is disposed (left side in FIGS. 1A and 1B) is set as a front side, and a side where an insulated wire 100 described later is disposed (right side in FIGS. 1A and 1B) is set as a rear side with respect to the box section 210. Further, an upper side in FIGS. 1A and 1B is set as an upper side, and a lower side in FIGS. 1A and 1B is set as a lower side.

The pressure-bonding connection structural body 1 is, as shown in FIG. 1A, formed by pressure-bonding the insulated wire 100 and the crimp terminal 200 to each other.

The insulated wire 100 is, as shown in FIG. 1B, formed by covering an aluminum core wire 101 which is formed by binding aluminum raw wires 101*a* with an insulating cover body 102 made of an insulating resin. Further, the insulated wire 100 exposes the aluminum core wire 101 from a distal end of the insulating cover body 102 by a predetermined length.

As shown in FIGS. 1A and 1B, the crimp terminal 200 is a female terminal, and is an integral body formed of the box section 210 which allows the insertion of a male tub of a male terminal not shown in the drawing therein, and the barrel portion 230 which is arranged behind the box section 210 by way of a transition section 220 having a predetermined length, wherein the box section 210 and the barrel portion 230 are arranged from a front side to a rear side in the long length direction X.

The crimp terminal 200 is a closed barrel-type terminal which is formed such that a copper alloy strip made of brass or the like (not shown in the drawing) and having a surface thereof plated with tin (Sn plating) is blanked in a shape of a terminal developed in plane and, thereafter, the strip is formed by bending into a stereoscopic terminal shape formed of the box section 210 having a hollow quadrangular columnar body and the barrel portion 230 having an approximately O-shape as viewed from a rear side, and the barrel portion 230 is welded.

The box section 210 is formed of a hollow quadrangular columnar body in a laid-down state having an approximately rectangular shape as viewed from a front side in the long length direction X where one of side surface portions 211 contiguously formed on both side portions in the width direction Y which is orthogonal to the long length direction X of a bottom surface portion (not shown in the drawing) is bent such that one side surface portion 211 overlaps with an end portion of the other side surface portion 211.

In the inside of the box section 210, a resilient contact lug 212 which is brought into contact with an insertion tub (not shown in the drawing) of a male terminal to be inserted is disposed. The resilient contact lug 212 is formed by extending a front side of the bottom surface portion in the long length direction X and by bending the extending portion toward a rear side in the long length direction X. In this embodiment, the detail illustration of the resilient contact lug 212 is omitted.

The barrel portion 230 is formed of an integral body constituted of a cover pressure-bonding section 231 which pressure-bonds a portion of the insulating cover body 102 in the vicinity of the distal end of the insulating cover body 102, and a conductor pressure-bonding section 232 which pressure-bonds the exposed aluminum core wire 101.

This will be described in more detail. The barrel portion 230 is, as shown in FIGS. 3A and 3B, formed to have an approximately O-shaped closed cross-sectional shape as viewed from a rear side such that a copper alloy strip blanked in a terminal shape is rounded so as to surround an outer periphery of the insulated wire 100 with an inner diameter slightly larger than an outer diameter of the insulated wire 100, end portions 230*a* which are rounded at portions corresponding to the barrel portion 230 of the crimp terminal 200 are made to abut against each other, and the end portions 230*a* are welded together along a welding portion W in the long length direction X.

Welding of the welding portion W (end portions 230*a*) is performed by single-focus fiber laser welding using a fiber laser welding apparatus FL. Fiber laser welding is welding using a fiber laser beam having a wavelength of approximately 1.08 μm. The fiber laser beam is an ideal Gaussian beam and is capable of being condensed up to a diffraction limit and hence, the fiber laser beam is a laser beam which can form a condensed light spot having a diameter of 30 μm or less which cannot be realized by a YAG laser and a $CO_2$ laser.

The barrel portion 230 can be formed by welding the end portions 230*a* to each other while applying annealing to the welding portion W by emitting the fiber laser beam from such a fiber laser welding apparatus FL and by moving the fiber laser welding apparatus FL in the long length direction X along the welding portion W. A portion where the end portions 230*a* are welded to each other is referred to as a welded part 230*b*.

In a pressure-bonded state where the insulated wire 100 is pressure-bonded, as shown in FIG. 1A and FIG. 2, the barrel portion 230 includes: a sealing portion 235 which is formed by deforming a front end of the barrel portion 230; a U-shaped conductor pressure-bonding section 232U which pressure-bonds the aluminum core wire 101; and a cover pressure-bonding section 2310 having an O-shape in a pressure-bonded state where the insulating cover body 102 is pressure-bonded by deforming the cover pressure-bonding section 231.

The sealing portion 235 seals a front opening of the barrel portion 230 in a pre-pressure-bonding state by deforming a front end of the barrel portion 230 in such a manner that the front end is depressed into a flat shape using a predetermined pressure-bonding die not shown in the drawing.

In a pressure-bonded state, the O-shaped cover pressure-bonding section 2310 forms such a pressure-bonded state where the insulating cover body 102 is pressure-bonded by deforming the cover pressure-bonding section 231 into which the insulated wire 100 is inserted to have an approximately O-shaped cross section using a predetermined pressure-bonding die.

In the pressure-bonded state, as shown in FIG. 2, the U-shaped conductor pressure-bonding section 232U has an approximately U-shaped cross-section in a pressure-bonded state where the aluminum core wire 101 is pressure-bonded by deforming the conductor pressure-bonding section 232 into which the insulated wire 100 is inserted using a pair of female and male dies 10 described later.

This will be described in more detail. The U-shaped conductor pressure-bonding section 232U in a pressure-bonded state is configured such that, in orthogonal cross section which is orthogonal to the long length direction X, a lower surface side of the conductor pressure-bonding section 232 is deformed to have a downwardly-projecting arcuate cross section and an upper surface side of the conductor pressure-bonding section 232 serves as an upper surface concave portion 234*a* in which an approximately center portion in the width direction Y is deformed into a downwardly-recessed concave cross section. Further, in the pressure-bonded state, the U-shaped conductor pressure-bonding section 232U forms projecting portions 234T (corner portions) which project upward on both outer sides of the conductor pressure-bonding section 232 in the width direction Y in orthogonal cross section orthogonal to the long length direction X.

That is, the U-shaped conductor pressure-bonding section 232U in a pressure-bonded state is configured to have an approximately U-shape in orthogonal cross section which is orthogonal to the long length direction X.

The upper surface concave portion 234*a* is a portion of the conductor pressure-bonding section 232 in the circumferential direction where an amount of displacement of the conductor pressure-bonding section 232 due to compression is increased compared to peripheral portions of the pressure-bonding section 232.

The projecting portions 234T are portions which are formed by bending deformation such that an amount of deformation by bending of the conductor pressure-bonding section 232 in the circumferential direction is increased compared to the peripheral portions of the conductor pressure-bonding section 232.

Next, Vickers hardness of the barrel portion 230 in a pre-pressure-bonding state is described by reference to FIGS. 4A and 4B.

Figure 4A:
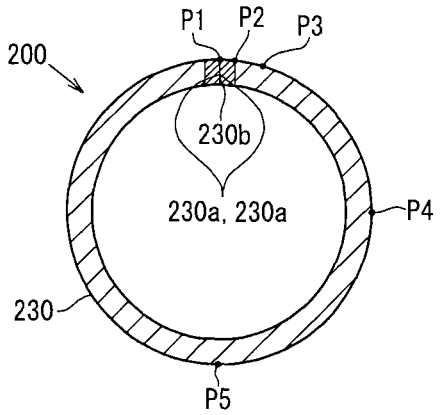
FIGS. 4A and 4B are explanatory views for describing Vickers hardness on the barrel portion.
Figure 4B:
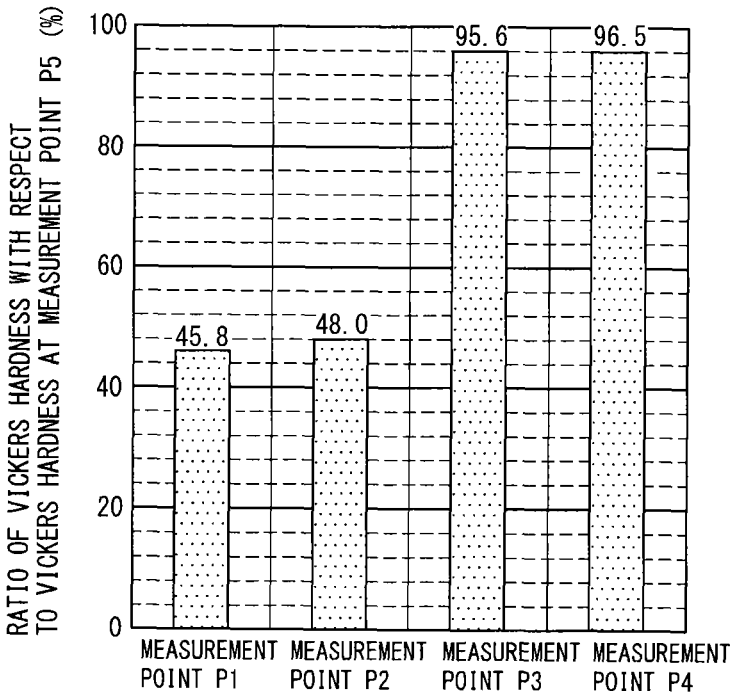

FIGS. 4A and 4B are explanatory views for describing Vickers hardness of the barrel portion 230. This will be described in more detail. FIG. 4A shows measurement positions of Vickers hardness in the barrel portion 230, and FIG. 4B shows ratios of Vickers hardness at the respective measurement positions with respect to Vickers hardness at the measurement position P5.

The Vickers hardness measurement positions in the barrel portion 230 are constituted of, as shown in FIG. 4A, the measurement point P1 where Vickers hardness at the substantially center of the welded part 230*b* in the circumferential direction is measured, the measurement point P2 where Vickers hardness at a boundary between the welded part 230*b* and a non-welded part in the circumferential direction is measured, the measurement point P3 where Vickers hardness at an area in the vicinity of the boundary in the circumferential direction is measured, the measurement point P4 where Vickers hardness on a side surface side of the barrel portion 230 is measured, and the measurement point P5 where Vickers hardness on a lower surface side of the barrel portion 230 is measured.

The measurement point P5 is remotest from the abutting end portions 230*a* to be welded by fiber laser welding in the circumferential direction of the conductor pressure-bonding section 232 and hence, heat is hardly transferred to the measurement point P5 whereby the measurement point P5 is the position at which it is difficult for the conductor pressure-bonding section 232 to acquire an annealing effect. Accordingly, the measurement point P5 is the position where Vickers hardness of the conductor pressure-bonding section 232 is substantially the same before and after the fiber laser welding is performed.

First, ratios of Vickers hardness at the respective measurement position of the barrel portion 230 with respect to Vickers hardness at the measurement point P5 take the following values as shown in FIG. 4B, that is, the ratio of Vickers hardness at the measurement point P1 is 45.8%, and the ratio of Vickers hardness at the measurement point P2 is 48.0%.

Both the measurement points P1, P2 are located in the welded part, and are the positions which correspond to abutting end portions 230*a* to which fiber laser welding is directly applied in the circumferential direction of the conductor pressure-bonding section 232. Accordingly, annealing is surely applied to the measurement points P1, P2 due to heat generated by fiber laser welding.

On the other hand, the ratios of Vickers hardness at the respective measurement positions of the barrel portion 230 with respect to the ratio of Vickers hardness at the measurement point P5 take the following values as shown in FIG. 4B. That is, the ratio of Vickers hardness at the measurement point P3 is 95.6% with reference to Vickers hardness at the measurement point P5, and the ratio of Vickers hardness at the measurement point P4 is 96.5% with reference to Vickers hardness at the measurement point P5.

Both the measurement points P3, P4 are located in the non-welded parts and hence, the measurement points P3, P4 are not directly heated by fiber laser welding, and are indirectly heated by heat transfer attributed to heating of abutting end portions 230*a*.

Accordingly, it is possible to suppress the lowering of ratios of Vickers hardness at the measurement points P3, P4 with respect to Vickers hardness at the measurement point P5 by an amount approximately less than 4%. Accordingly, there is no possibility that Vickers hardness at the measurement points P3, P4 is excessively lowered by annealing and hence, the barrel portion 230 at the measurement points P3, P4 can be annealed to have proper hardness without excessively lowering hardness by annealing.

That is, the portions of the conductor pressure-bonding section 232 in a pre-pressure-bonding state at positions which correspond to the measurement points P3, P4 in the circumferential direction can be annealed to acquire properties including high hardness, high strength and high toughness compared to hardness, strength and toughness of the portion at the measurement point P5.

Subsequently, a step of forming the pressure-bonding connection structural body 1 by inserting the insulated wire 100 into the barrel portion 230 of the crimp terminal 200 having the above-mentioned constitution, and by pressure-bonding the barrel portion 230 by caulking is described in detail by reference to FIGS. 5A and 5B.

Figure 5B:
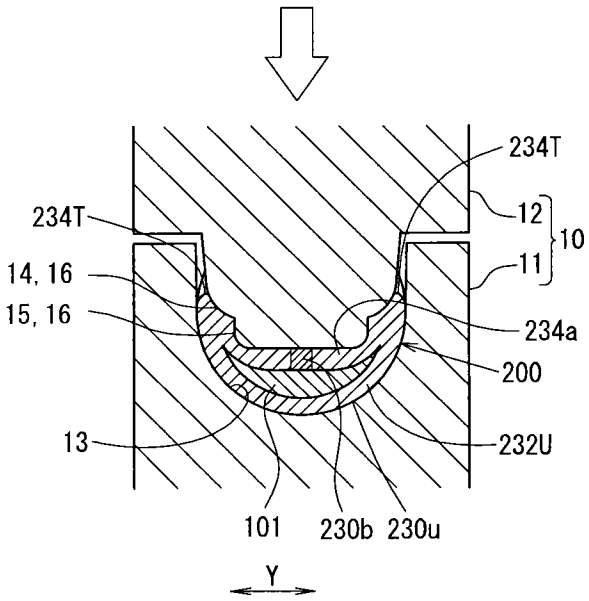
FIGS. 5A and 5B are explanatory views for describing a pressure-bonding step in a conductor pressure-bonding section.
Figure 5A:
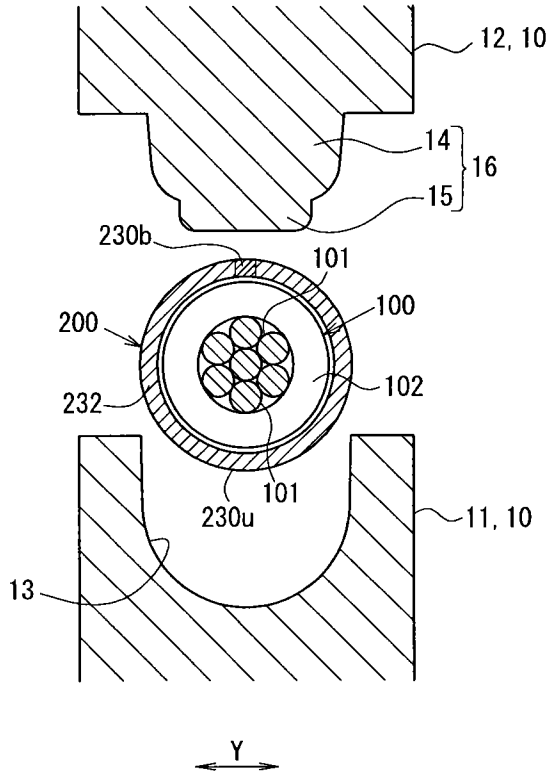

FIGS. 5A and 5B are explanatory views for describing a pressure-bonding step at the conductor pressure-bonding section 232, wherein FIG. 5A shows a state of the conductor pressure-bonding section 232 in a pre-pressure-bonding state, and FIG. 5B shows a state where the U-shaped conductor pressure-bonding section 232U is formed by pressure-bonding the conductor pressure-bonding section 232.

First, as shown in FIG. 1B, a distal end portion of the insulated wire 100 where the aluminum core wire 101 is exposed is inserted into the barrel portion 230 of the crimp terminal 200 from a rear side in the long length direction X. The barrel portion 230 is formed to have an inner diameter slightly larger than an outer diameter of the insulated wire 100 and hence, the insulated wire 100 is inserted into the barrel portion 230.

As shown in FIGS. 5A and 5B, with the insulated wire 100 inserted into the barrel portion 230, the aluminum core wire 101 and the crimp terminal 200 are pressure-bonded to each other by caulking the conductor pressure-bonding section 232 of the barrel portion 230 in the vertical direction using the pair of female and male dies 10. Although the detailed description of the pressure-bonding of portions of the barrel portion 230 other than the conductor pressure-bonding section 232 in the long length direction X is omitted, the cover pressure-bonding section 231 of the barrel portion 230 is also caulked using suitable pressure-bonding dies different from the pair of female and male dies 10 thus pressure-bonding the insulating cover body 102. Further, the sealing portion 235 is formed by deforming an end portion of the barrel portion 230 in front of the conductor pressure-bonding section 232 using suitable pressure-bonding dies different from the pair of female and male dies 10 in such a manner that the end portion is depressed into an approximately flat shape.

This will be described in more detail. The pair of female and male dies 10 is constituted of a female die 11 and a male die 12 having the two-split structure in the vertical direction as shown in FIG. 5A and having a length in the long length direction X which enables the pressure-bonding of the conductor pressure-bonding section 232.

The female die 11 is formed into an approximately inverted gate shape by a receiving groove portion 13 which is formed into an approximately U-shape with a diameter slightly smaller than an outer diameter of the conductor pressure-bonding section 232 in a cross section in the width direction Y.

The male die 12 is, in a cross section in the width direction Y, formed into a cross-sectional shape having a pressure-bonding projecting portion 16 which is an integral body formed of a first projecting portion 14 projecting downward with a length in the width direction Y which allows the fitting of the first projecting portion 14 into the receiving groove portion 13 of the female die 11, and a second projecting portion 15 projecting downward while having a length in the width direction Y smaller than the length of the first projecting portion 14 in the width direction Y.

When the female die 11 and the male die 12 are assembled to each other in the vertical direction, an inner surface shape defined by the receiving groove portion 13 of the female die 11 and the pressure-bonding projecting portion 16 of the male die 12 is formed into a U-shape in a pressure-bonded state where the conductor pressure-bonding section 232 into which the aluminum core wire 101 is inserted is deformed.

In a state where the female die 11 and the male die 12 which form the pair of female and male dies 10 are spaced apart from each other by a predetermined distance in the vertical direction as shown in FIG. 5A, the conductor pressure-bonding section 232 into which the insulated wire 100 is inserted is inserted between the male die 12 and the female die 11 such that the substantially center portion of the second projecting portion 15 of the male die 12 in the width direction Y and the welded part 230*b* face each other in an opposed manner.

As shown in FIG. 5B, when the pressure-bonding projecting portion 16 of the male die 12 presses an upper surface of the conductor pressure-bonding section 232, a lower surface of the conductor pressure-bonding section 232 is pushed into the inside of the receiving groove portion 13. At this point of time, the lower surface of the conductor pressure-bonding section 232 is plastically deformed along an inner surface shape of the receiving groove portion 13 of the female die 11 and, at the same time, the upper surface of the conductor pressure-bonding section 232 is plastically deformed along an outer shape of the pressure-bonding projecting portion 16 of the male die 12 thus pressure-bonding the aluminum core wire 101 as shown in FIG. 2. Accordingly, the conductor pressure-bonding section 232U is formed into a U-shape in a pressure-bonded state.

In such a pressure-bonded state, the U-shaped conductor pressure-bonding section 232U, in a cross section in the width direction Y, has a lower surface side thereof formed into a downwardly-projecting arcuate cross-sectional shape due to the receiving groove portion 13, and has an upper surface side thereof which projects upward in a pre-pressure-bonding state formed into a downwardly-recessed concave cross-sectional shape due to the pressure-bonding projecting portion 16 and hence, the U-shaped conductor pressure-bonding section 232U is formed into a U-shaped cross-sectional shape.

As described above, the pressure-bonding connection structural body 1 is formed where the insulated wire 100 and the crimp terminal 200 are connected to each other by pressure-bonding by caulking the barrel portion 230 of the crimp terminal 200, and the conductivity between the aluminum core wire 101 and the crimp terminal 200 is ensured.

The crimp terminal 200, the pressure-bonding connection structural body 1, and a method of manufacturing the pressure-bonding connection structural body 1 having the above-mentioned constitution can avoid the generation of cracks at the time of pressure-bonding and, at the same time, make the pressure-bonding resistance stable.

This will be described in more detail. For example, the crimp terminal 200 which is formed through cold working such as a blanking step of blanking a copper alloy strip having a shape of a terminal developed in plane from a copper alloy sheet and a bending step of bending portions of the blanked copper alloy strip corresponding to a barrel portion 230 before being formed into the barrel portion 230 into a cylindrical shape and the like is hardened by work hardening due to the above-mentioned cold working. Such a crimp terminal 200 has hardness several times as large as hardness of a terminal base material before being subjected to the cold working.

In this case, there arises a drawback that when the barrel portion 230 of the crimp terminal 200 which is hardened by work hardening is pressure-bonded to the aluminum core wire 101, the barrel portion 230 cannot exhibit the desired followability to the pair of female and male dies 10 in pressure-bonding thus giving rise to a drawback that pressure-bonding cracks may occur which causes the rupture of the barrel portion 230 or a drawback that the pressure-bonding becomes insufficient so that the barrel portion 230 is largely influenced by pressure-bonding resistance.

This will be described in more detail. In the circumferential direction of the conductor pressure-bonding section 232, particularly the upper surface concave portion 234*a* and the projecting portion 234T are plastically deformed such that an amount of plastic deformation is locally increased on peripheral portions of the upper surface concave portion 234*a* and the projecting portion 234T.

The upper surface concave portion 234*a* is a portion formed by compression deformation where an amount of displacement in the circumferential direction of the conductor pressure-bonding section 232 is increased compared to the peripheral portion, while the projecting portion 234T is a portion formed by bending deformation where an amount of deformation by bending in the circumferential direction of the conductor pressure-bonding section 232 is increased compared to the peripheral portion.

Accordingly, in the circumferential direction of the conductor pressure-bonding section 232, there is a possibility that cracks are generated in the upper surface concave portion 234*a* or the projecting portion 234T or a possibility that pressure-bonding becomes insufficient so that an influence of resistance to pressure-bonding is increased at the time of pressure-bonding the barrel portion 230 of the crimp terminal 200 to the aluminum core wire 101.

In contrast, in this embodiment, by forming the welded part 230*b* where the end portions 230*a* are welded to each other in the circumferential direction of the conductor pressure-bonding section 232, it is possible to acquire an annealing effect that strain generated in the inside of the barrel portion 230 which is hardened by work hardening can be removed.

This will be described in more detail. A portion of the conductor pressure-bonding section 232 in a pre-pressure-bonding state corresponding to the upper surface concave portion 234*a* in the circumferential direction is a position corresponding to the above-mentioned measurement point P1, P2 in FIG. 4A. As can be clearly understood from a graph shown in FIG. 4B, Vickers hardness can be largely decreased at such a position compared to the measurement point P5.

That is, the abutting end portions 230*a* are located at the position in the circumferential direction of the conductor pressure-bonding section 232 in a pre-pressure-bonding state corresponding to the upper surface concave portion 234*a* and hence, it is possible to sufficiently anneal the portion of the conductor pressure-bonding section 232 corresponding to the upper surface concave portion 234*a* in welding the abutting end portions 230*a* by fiber laser welding.

Accordingly, along with the pressure-bonding of the barrel portion 230 of the crimp terminal 200 to the aluminum core wire 101, in the circumferential direction of the conductor pressure-bonding section 232, particularly, even when the portion of the conductor pressure-bonding section 232 corresponding to the upper surface concave portion 234*a* is deformed by a locally increased amount of displacement compared to the peripheral portion, there is no possibility that cracks are generated in the upper surface concave portion 234*a* whereby the barrel portion 230 can be pressure-bonded to the aluminum core wire 101 in a state where the barrel portion 230 surely follows the pressure-bonding blade die.

Further, a portion of the conductor pressure-bonding section 232 corresponding to the projecting portion 234T is located at a position corresponding to the above-mentioned measurement point P4 in FIG. 4A or at a position in the vicinity of the measurement point P4 in the circumferential direction of the conductor pressure-bonding section 232. As can be clearly understood from a graph shown in FIG. 4B, it is possible to suppress the lowering of ratios of Vickers hardness at such a portion with respect to Vickers hardness at the measurement point P5 by an amount approximately less than 4%.

The portions corresponding to the projecting portions 234T are positioned on both sides of the welded part in the width direction of the conductor pressure-bonding section 232 in a pre-pressure-bonding state and hence, when the abutting end portions 230*a* are welded to each other by fiber laser welding so as to form the welded part 230*b*, there is no possibility that the portions corresponding to the projecting portions 234T are directly heated and hence, heat applied to the abutting end portions 230*a* is transferred in the circumferential direction of the conductor pressure-bonding section 232 so that hardness of the portion is not excessively lowered due to the transferred heat. Accordingly, the portion corresponding to the projecting portion 234T can be annealed to have proper hardness.

That is, due to heating of the abutting end portions 230*a* by fiber laser welding, the projecting portion 234T can be annealed such that the projecting portions 234T can acquire proper hardness, strength and toughness as described above.

Accordingly, along with pressure-bonding of the barrel portion 230 of the crimp terminal 200 to the aluminum core wire 101, in the circumferential direction of the conductor pressure-bonding section 232, particularly, even when the portion corresponding to the projecting portion 234T is deformed by a locally increased amount of displacement compared to the peripheral portion, there is no possibility that cracks attributed to pressure-bonding are generated in the projecting portion 234T whereby the portion can be pressure-bonded in a state where the portion surely follows the pressure-bonding blade die.

Accordingly, the barrel portion 230 can be pressure-bonded to the exposed aluminum core wire 101 with no gap therebetween in a state where the barrel portion 230 is surely brought into close contact with the aluminum core wire 101 and hence, it is possible to acquire excellent water-blocking performance and excellent conductivity.

Further, the pressure-bonding connection structural body 1 where the conductor pressure-bonding section 232 and the aluminum core wire 101 are pressure-bonded to each other can be formed after preliminarily eliminating work hardening of portions such as the upper surface concave portion 234*a* and the projecting portion 234T, for example, which locally generates the plastic deformation compared to the peripheral portion along with the compression of the barrel portion 230. Accordingly, it is possible to provide the pressure-bonding connection structural body 1 where there exists no cracks in the barrel portion 230 and the barrel portion 230 is pressure-bonded to the exposed aluminum core wire 101 with no gap therebetween in a state where the barrel portion 230 is surely brought into close contact with the aluminum core wire 101. That is, it is possible to provide the pressure-bonding connection structural body 1 which can acquire excellent water-blocking performance and excellent conductivity.

By welding the end portions 230*a* to each other by fiber laser welding, the barrel portion 230 having no gap can be formed thus manufacturing the crimp terminal 200 which can surely prevent the intrusion of moisture into the inside of the barrel portion 230 in a pressure-bonded state. This will be described in more detail. The fiber laser can set a focal point on an extremely small spot compared to other welding lasers and hence, the fiber laser can realize high-output laser welding and, at the same time, can continuously emit a laser beam. Accordingly, by performing the welding having reliable water-blocking performance, the crimp terminal 200 which can ensure the sufficient water-blocking performance in a pressure-bonded state can be manufactured.

In the above-mentioned embodiment, the core wire of the insulated wire 100 is made of an aluminum alloy, and the crimp terminal 200 is made of a copper alloy such as brass. However, materials of the core wire and the crimp terminal 200 are not limited to such materials, and the core wire of the insulated wire 100 and the crimp terminal 200 may be made of the same material, for example, a copper alloy such as brass or an aluminum alloy.

The crimp terminal 200 is formed of a female crimp terminal. However, the crimp terminal 200 is not limited to the female crimp terminal, and the crimp terminal 200 may be formed of a male crimp terminal which is fitted in a female crimp terminal in the long length direction X. Further, the box section 210 may be replaced with an approximately U-shaped or an annular flat plate. Further, the aluminum core wire 101 is not limited to a single wire formed by binding aluminum alloy wires which constitute a plurality of raw wires together, and may be constituted as a stranded wire formed by stranding a plurality of aluminum alloy wires.

The abutting end portions 230*a* are welded to each other by fiber laser welding. However, a welding method is not limited to such a welding method, and another welding method such as gas welding, for example, may be adopted provided that the end portions 230*a* can be welded to each other and at least a portion of the barrel portion 230 in the circumferential direction can be annealed.

The barrel portion 230 is formed using a copper alloy strip which is blanked such that the cover pressure-bonding section 231 and the conductor pressure-bonding section 232 have the substantially same diameters. However, the barrel portion 230 is not limited to such a constitution. As described later, the barrel portion 230 may be formed using a copper alloy strip which is blanked such that the cover pressure-bonding section 231 and the conductor pressure-bonding section 232 in a pre-pressure-bonding state have different inner diameters.

The sealing portion 235 is formed on the distal end of the barrel portion 230. However, the distal end of the barrel portion 230 is not limited to such a constitution, and the distal end of the barrel portion 230 may be sealed by a member different from the sealing portion 235.

Figure 6:
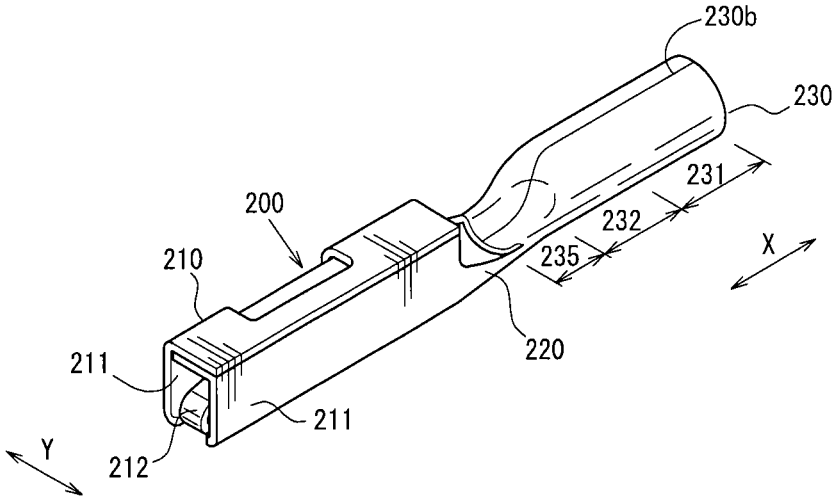
FIG. 6 is an appearance perspective view showing an appearance of another crimp terminal as viewed obliquely from an upper side.

In the embodiment, the barrel portion 230 of the crimp terminal 200 is formed into an approximately cylindrical shape, and the sealing portion 235 is formed by depressing the distal end of the barrel portion 230 at the time of connecting the insulated wire 100 and the crimp terminal 200 to each other by pressure-bonding. However, the present invention is not limited to such a constitution. For example, as shown in FIG. 6 which is an appearance perspective view of another crimp terminal as viewed from above, a crimp terminal 200 may be adopted where a sealing portion 235 is formed by preliminarily depressing the distal end of the barrel portion 230.

Figure 7A:
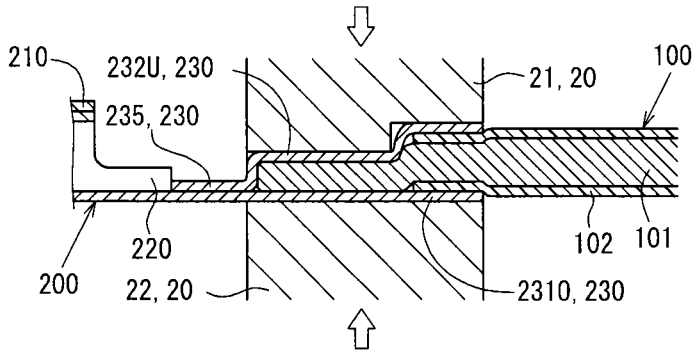
FIGS. 7A and 7B are explanatory views for describing another pressure-bonding step in the barrel portion.
Figure 7B:
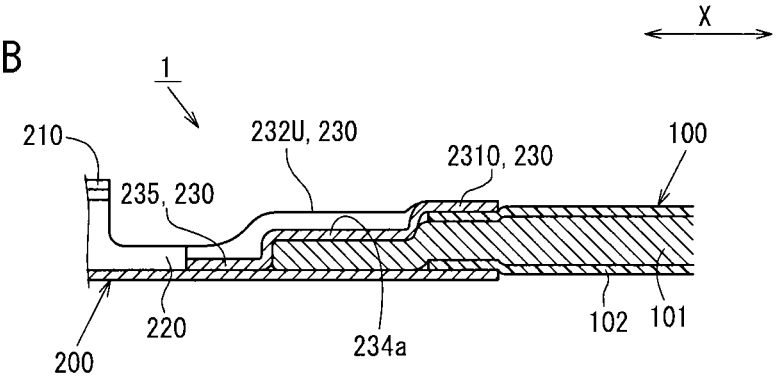

The conductor pressure-bonding section 232 and the cover pressure-bonding section 231 are pressure-bonded using the different pressure-bonding dies. However, the method of pressure-bonding the conductor pressure-bonding section 232 and the cover pressure-bonding section 231 to each other is not limited to such a method. For example, as shown in FIGS. 7A and 7B which are explanatory views for describing another pressure-bonding step of the barrel portion 230, with an insulated wire 100 inserted, by pressure-bonding a conductor pressure-bonding section 232 and a cover pressure-bonding section 231 simultaneously using a pair of pressure-bonding dies 20 which is constituted of an upper die 21 and a lower die 22, a cover pressure-bonding section 2310 having an O-shape and a conductor pressure-bonding section 232U having a U-shape in a pressure-bonded state may be formed.

In this case, when the conductor pressure-bonding section 232 and the cover pressure-bonding section 231 are pressure-bonded simultaneously, the large compression deformation (plastic deformation) such as the formation of a stepped portion is forcibly generated in a boundary portion between the conductor pressure-bonding section 232 and the cover pressure-bonding section 231.

By performing a welding step along the long length direction X of the barrel portion 230 in a pre-pressure-bonding state which is hardened by work hardening through cold working such as a blanking step and a bending step, hardening of the barrel portion 230 caused by such work hardening can be eliminated by an annealing effect.

Accordingly, even when the conductor pressure-bonding section 232 and the cover pressure-bonding section 231 are pressure-bonded simultaneously in the pressure-bonding step, the followability of the conductor pressure-bonding section 232 and the cover pressure-bonding section 231 to the pair of pressure-bonding dies 20 is enhanced. Even when deformation such as a stepped portion is generated in the boundary portion between the conductor pressure-bonding section 232 and the cover pressure-bonding section 231, it is possible to avoid the generation of cracks at the time of pressure-bonding the barrel portion 230 including the boundary portion and, at the same time, it is possible make the pressure-bonding resistance stable.

Accordingly, the barrel portion 230 can be pressure-bonded to the insulated wire 100 with no gap therebetween in a state where the barrel portion 230 is surely brought into close contact with the insulated wire 100 and hence, it is possible to acquire excellent water-blocking performance and excellent conductivity.

Figure 8:
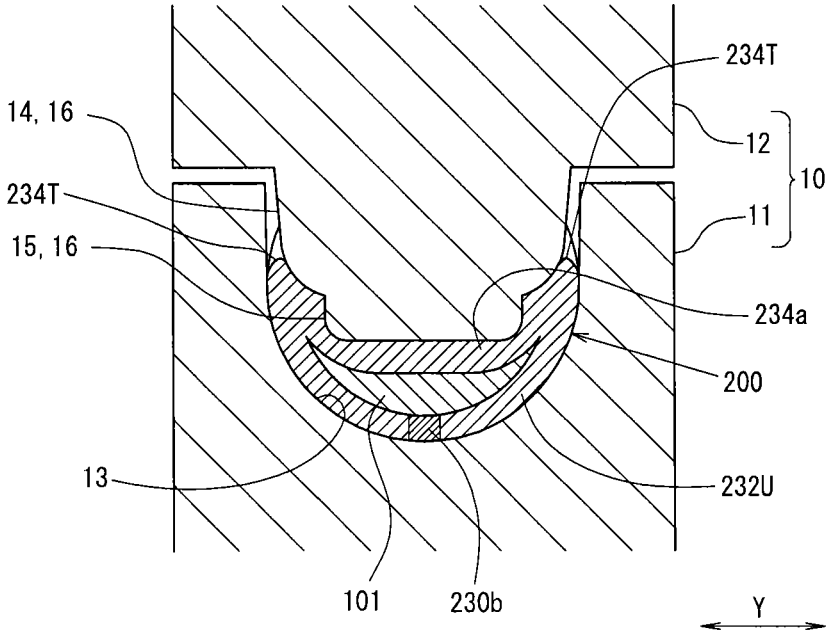
FIG. 8 is a cross-sectional view showing a cross-section of another U-shaped pressure-bonding section in a width direction.

The crimp terminal 200 is formed such that the welded part 230*b* is positioned on the upper surface concave portion 234*a* of the U-shaped conductor pressure-bonding section 232U in a pressure-bonded state. However, the crimp terminal 200 is not limited to such a constitution. As shown in FIG. 8 which is a cross-sectional view of a U-shaped conductor pressure-bonding section 232U in the width direction Y which differs from the above-mentioned U-shaped conductor pressure-bonding section 232U, a crimp terminal 200 may be adopted where a welded part 230*b* is positioned at the substantially center in the width direction Y of a lower portion 230*u* of the U-shaped conductor pressure-bonding section 232U.

When the aluminum core wire 101 and the crimp terminal 200 are pressure-bonded to each other by caulking the conductor pressure-bonding section 232 of the barrel portion 230 using the pair of female and male dies 10 in the vertical direction as shown in FIGS. 5A and 5B, a tensile stress is applied to the lower portion 230*u* of the conductor pressure-bonding section 232 such that the lower portion 230*u* is plastically deformed along the receiving groove portion 13 having a concave shape of the female die 11. Accordingly, particularly, in the lower portion 230*u* of the conductor pressure-bonding section 232, an amount of displacement of a position in the lower portion 230*u* along with the pulling is increased compared to portions of the conductor pressure-bonding section 232 other than the lower portion 230*u* in the circumferential direction.

By setting the barrel portion 230 such that the welded part 230*b* is positioned at an intermediate portion in the width direction of a lower surface side of the conductor pressure-bonding section 232, the barrel portion 230 can acquire a large annealing effect. Accordingly, when the conductor pressure-bonding section 232 is pressure-bonded to the aluminum core wire 101, the conductor pressure-bonding section 232 can be made to follow the shape of the receiving groove portion 13 of the female die 11 including the lower portion 230*u*.

The conductor pressure-bonding section 232 is formed by deforming the conductor pressure-bonding section 232 into which the insulated wire 100 is inserted into a U-shaped cross section. However, a cross-sectional shape of the conductor pressure-bonding section 232 is not limited to such a shape, and the conductor pressure-bonding section 232 may be formed into any cross-sectional shape provided that the conductor pressure-bonding section 232 can acquire a pressure-bonded state where the favorable connection state between the conductor pressure-bonding section 232 and the aluminum core wire 101 can be ensured in a pressure-bonded state.

Figure 9A:
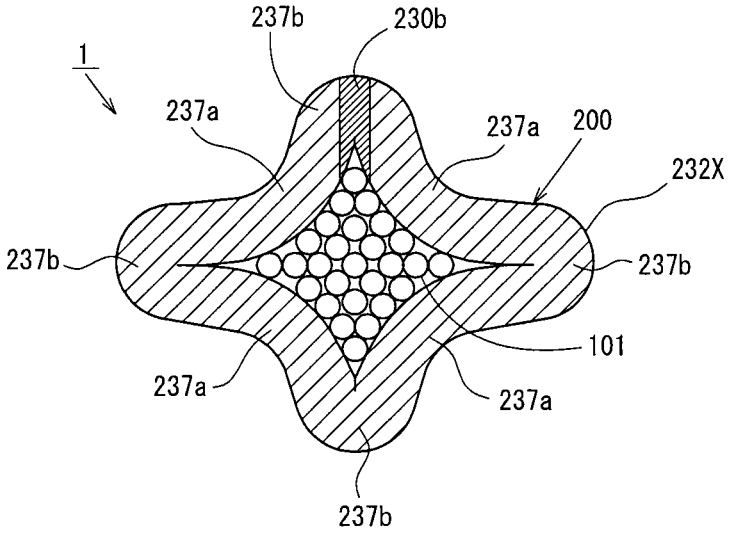
FIGS. 9A and 9B are cross-sectional views showing another pressure-bonding states of the conductor pressure-bonding section.

For example, the conductor pressure-bonding section 232 may be configured, as shown in FIG. 9A which is a cross-sectional view of another pressure-bonding state of the conductor pressure-bonding section 232, such that the conductor pressure-bonding section 232 is pressure-bonded by a predetermined pressure-bonding die in a state where the aluminum core wire 101 is inserted into the conductor pressure-bonding section 232, and a cross-sectional shape orthogonal to the long length direction X is formed into an approximately cruciform cross-sectional shape in a pressure-bonded state.

In such a pressure-bonded state, a cruciform conductor pressure-bonding section 232X is constituted of four concave groove portions 237*a* which are recessed toward the center in the width direction Y of the aluminum core wire 101, and four projecting portions 237*b* which project in the vertical direction and in the width direction Y due to the formation of the concave groove portions 237*a*.

When the conductor pressure-bonding section 232X having a cruciform shape in such a pressure-bonded state is adopted, along with the compression of the conductor pressure-bonding section 232 in a pre-pressure-bonding state, a working ratio (amount of plastic deformation) of portions of the conductor pressure-bonding section 232 corresponding to the projecting portions 237*b* or the concave groove portions 237*a* in the circumferential direction is increased.

Additionally, the conductor pressure-bonding section 232X having a cruciform shape in a pressure-bonded state is formed into a symmetrical shape such that the projecting portions 237*b* or the concave groove portions 237*a* are positioned on the welded part 230*b* or on both sides in the width direction Y of the conductor pressure-bonding section 232 in a pre-pressure-bonding state with respect to the welded part 230*b*.

Accordingly, when the abutting end portions 230*a* are welded to each other by fiber laser welding, hardening of portions of the conductor pressure-bonding section 232 in a pre-pressure-bonding state in the circumferential direction corresponding to at least the projecting portions 237*b* and the concave groove portions 237*a* generated by work hardening can be eliminated thus surely acquiring an annealing effect.

Accordingly, it is preferable that the welded part 230*b* be located at the top portion of the projecting portion 237*b* or at the concave groove portion 237*a*.

Figure 9B:
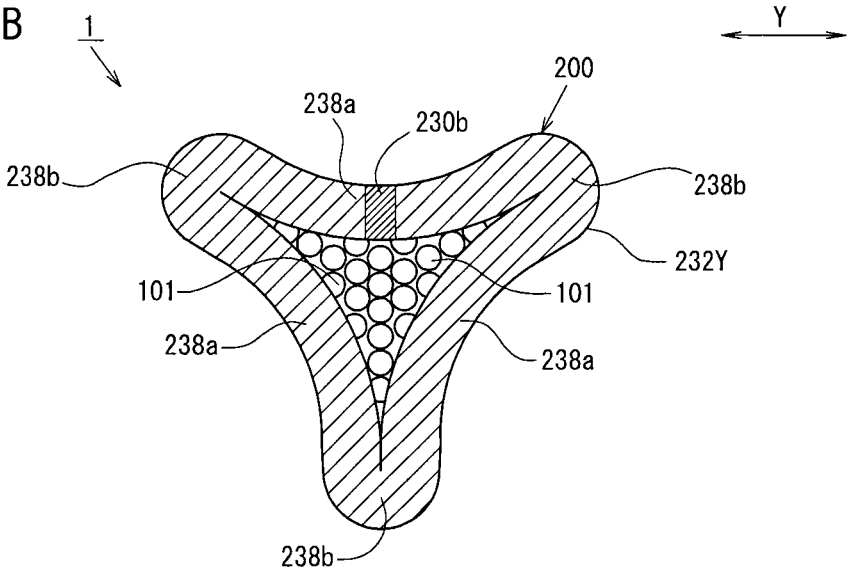

As shown in FIG. 9B which is a cross-sectional view of the conductor pressure-bonding section 232 in another pressure-bonded state, the conductor pressure-bonding section 232 into which the aluminum core wire 101 is inserted may be pressure-bonded using a predetermined pressure-bonding die, and a conductor pressure-bonding section 232Y may be formed such that a cross-sectional shape of the conductor pressure-bonding section 232Y in the long length direction X in a pressure-bonded state is formed into an approximately Y-shape in cross section.

The conductor pressure-bonding section 232Y having a Y-shaped cross-sectional shape in a pressure-bonded state is constituted of three concave groove portions 238*a* which are recessed toward the center of the aluminum core wire 101 in the width direction Y, and projecting portions 238*b* which project in the downward direction and obliquely in the upward directions due to the formation of the concave groove portions 238*a*. In forming the conductor pressure-bonding section 232Y which has a Y-shaped cross-sectional shape in a pressure-bonded state, the welded part 230*b* may be located at a top portion of the projecting portion 238*b* or at the concave groove portion 238*a*.

Due to such a constitution, it is possible to acquire the substantially same annealing effect as the above-mentioned conductor pressure-bonding section 232X which having a cruciform shape in cross section in a pressure-bonded state.

Accordingly, although the conductor pressure-bonding section 232Y has the plurality of projecting portions 238*b* and the concave groove portions 238*a*, the conductor pressure-bonding section 232Y can acquire an annealing effect in the substantially same manner as in the above-mentioned conductor pressure-bonding section 232X which has a cruciform shape in cross section in a pressure-bonded state. Accordingly, there is no possibility that cracks are generated along with the pressure-bonding of the conductor pressure-bonding section 232Y to the aluminum core wire 101 and hence, the conductor pressure-bonding section 232Y can be surely plastically deformed such that the conductor pressure-bonding section 232Y has a Y-shape in the orthogonal cross section.

Figure 10:
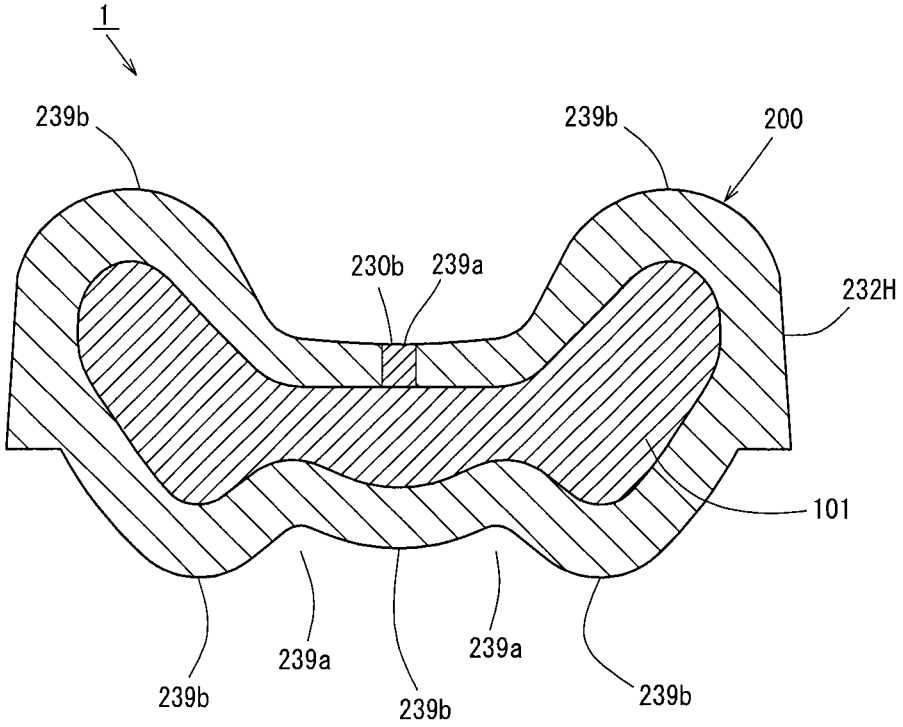
FIG. 10 is a cross-sectional view showing another pressure-bonding state of the conductor pressure-bonding section.

As shown in FIG. 10 which is a cross-sectional view of the conductor pressure-bonding section 232 in another pressure-bonded state, with the aluminum core wire 101 inserted, by pressure-bonding the conductor pressure-bonding section 232 using a predetermined pressure-bonding die, a cross-sectional shape of the conductor pressure-bonding section 232H in the long length direction X in a pressure-bonded state may be formed into an approximately H-shape in cross section.

The conductor pressure-bonding section 232H which has an H-shape in cross section in a pressure-bonded state has a shape where both outer side portions of an intermediate portion in the width direction project in the upward and downward directions, a welded part is formed on an upper portion of the intermediate portion in the width direction, and both sides of the intermediate portion in the width direction are formed in left and right symmetry.

In the conductor pressure-bonding section 232H, projecting portions 239*b* which project in the upward and downward directions are arranged on both outer side portions and on the intermediate portion in the width direction, and concave groove portions 239*a* are arranged on the intermediate portions in the width direction.

Due to such a constitution, although the conductor pressure-bonding section 232H has the plurality of projecting portions 239*b* and the concave groove portions 239*a*, it is possible to acquire an annealing effect in the same manner as in the conductor pressure-bonding section 232X which has a cruciform shape in cross section in a pressure-bonded state and hence, there is no possibility that cracks are generated along with the pressure-bonding of the conductor pressure-bonding section 232H to the aluminum core wire 101 and hence, the conductor pressure-bonding section 232H can be surely plastically deformed such that the conductor pressure-bonding section 232H has an H-shape in the orthogonal cross section.

To describe the correspondence between the constitution of the present invention and the constitution of the above-mentioned embodiment, they are as follows.

The conductor of the present invention corresponds to the aluminum core wire 101 of the embodiment.

In the same manner, the insulating cover corresponds to the insulating cover body 102, the conductor tip corresponds to the exposed aluminum core wire 101, the pressure-bonding section corresponds to the barrel portion 230, the pressure-bonding section in a pre-pressure-bonding state corresponds to the conductor pressure-bonding section 232, the abutting end portion corresponds to the end portion 230*a*, the plastic deformation portion corresponds to the upper surface concave portion 234*a*, the projecting portion 234T, the lower portion 230*u* of the U-shaped pressure-bonding section 232U, the projecting portion 237*b*, the concave groove portion 237*a*, projecting portion 238*b*, the concave groove portion 238*a*, the projecting portion 239*b*, and the concave groove portion 239*a*, the pressure-bonding section in a post-pressure-bonding state corresponds to the conductor pressure-bonding section 232U which has a U-shape in cross section in a pressure-bonded state, the conductor pressure-bonding section 232X which has a cruciform shape in cross section in a pressure-bonded state, the conductor pressure-bonding section 232Y which has a Y-shape in cross section in a pressure-bonded state, and the conductor pressure-bonding section 232H which has an H-shape in cross section in a pressure-bonded state, the connection structural body corresponds to the pressure-bonding connection structural body 1, and the cover tip portion corresponds to a portion in the vicinity of a tip of the insulating cover body 102.

However, the present invention is not limited to the constitution of the above-mentioned embodiments, and can take various embodiments.

For example, the above-mentioned effect of annealing the crimp terminal 200 is not limited to the case where workability is enhanced on a portion at which the barrel portion 230 is forced to be deformed with a large working ratio (amount of plastic deformation) in a pressure-bonding step of pressure-bonding the conductor pressure-bonding section 232 to the aluminum core wire 101 by deforming the conductor pressure-bonding section 232 by compression.

Further, the effect of annealing the crimp terminal 200 is not limited to the case where heat is applied to the welding portion W of the barrel portion 230 at the time of welding in a welding step. The crimp terminal annealing effect can be acquired in steps other than the welding step. The crimp terminal annealing effect is not limited to the case where the crimp terminal annealing effect is acquired by a welding means such as the fiber laser welding apparatus FL, and the crimp terminal annealing effect can be acquired by applying heat to portions other than the welding portion W of the crimp terminal 200 using a means other than the welding means.

For example, when bending is applied to the copper alloy strip which is blanked in a terminal shape in a blanking step with a large working ratio (amount of plastic deformation) in forming the barrel portion 230, by repeating bending and applying of heat for annealing, it is possible to accurately and easily prepare the crimp terminal 200 even when the crimp terminal 200 has a complicated terminal shape.

With respect to a crimp terminal 200 of another embodiment, a shape of the barrel portion 230 is not limited to a cylindrical shape having the same diameter along the long length direction X (fore-and-aft direction X). As another embodiment, the barrel portion 230 may be formed in a stepped manner such that a diameter of the barrel portion 230 is changed in the long length direction X as shown in FIG. 11.

Figure 11:
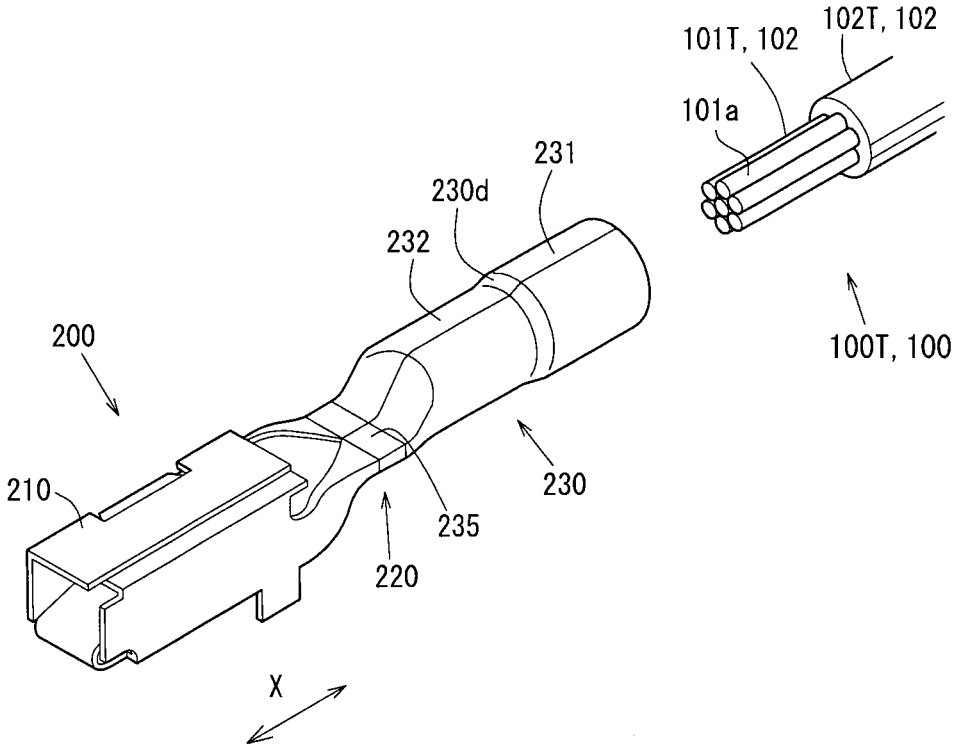
FIG. 11 is a cross-sectional view of a conductor pressure-bonding section of a crimp terminal according to another embodiment.

FIG. 11 is a perspective view of a crimp terminal 200 according to another embodiment.

This will be described in more detail. The barrel portion 230 is an integral body formed of a conductor pressure-bonding section 232, a stepped portion 230*d* and a cover pressure-bonding section 231.

In the description made hereinafter, a distal end side of the insulated wire 100 is set as a wire tip 100T, an exposed portion of an aluminum core wire 101 on a distal end side of the wire tip 100T is set as a core wire tip 101T, and an insulating cover 102 behind the core wire tip 101T of the wire tip 100T is set as a cover tip 102T.

The conductor pressure-bonding section 232 is a portion corresponding to the inserted core wire tip 101T in the long length direction X in a state where the wire tip 100T is inserted into the barrel portion 230. The conductor pressure-bonding section 232 has an inner diameter which is substantially equal to or slightly larger than an outer diameter of the core wire tip 101T, and is smaller than a diameter of the cover pressure-bonding section 231.

The cover pressure-bonding section 231 is a portion corresponding to the inserted cover tip 102T in the long length direction X in a state where the wire tip 100T is inserted into the barrel portion 230. The cover pressure-bonding section 231 has an inner diameter which is substantially equal to or slightly larger than an outer diameter of the cover tip 102T.

The stepped portion 230*d* is not formed in a stepped shape in the direction orthogonal to the long length direction X, but is formed into a stepped shape where a diameter of the stepped portion 230*d* is smoothly decreased from the cover pressure-bonding section 231 to the conductor pressure-bonding section 232.

According to the above-mentioned crimp terminal 200 having the above-mentioned barrel portion 230 which is formed into a stepped shape, a gap formed between the conductor pressure-bonding section 232 and the core wire tip 101T is smaller compared to a conductor pressure-bonding section of a conventional barrel portion which is not formed into a stepped shape. Accordingly, a compression amount of the conductor pressure-bonding section 232 toward the radially inward direction can be suppressed at the time of connecting the conductor pressure-bonding section 232 to the core wire tip 101T by pressure-bonding so that the generation of an extra large wall thickness portion can be prevented.

Accordingly, the cover pressure-bonding section 231 can be surely brought into close contact with the cover tip 102T and hence, the excellent water-blocking performance in the inside of the barrel portion 230 can be ensured. Further, the conductor pressure-bonding section 232 can be brought into close contact with the core wire tip 101T and hence, irregularity in electric characteristic can be suppressed thus acquiring excellent electric characteristic.

This will be described in more detail. A conventional barrel portion which is not formed into a stepped shape forms a larger gap between the conductor pressure-bonding section and the core wire tip 101T compared to the barrel portion 230 of this embodiment which is formed into a stepped shape. Accordingly, an amount of deformation of the conductor pressure-bonding section in the radially inward direction is increased at the time of connecting the conductor pressure-bonding section to the core wire tip 101T by pressure-bonding.

Figures 14A, 14B:
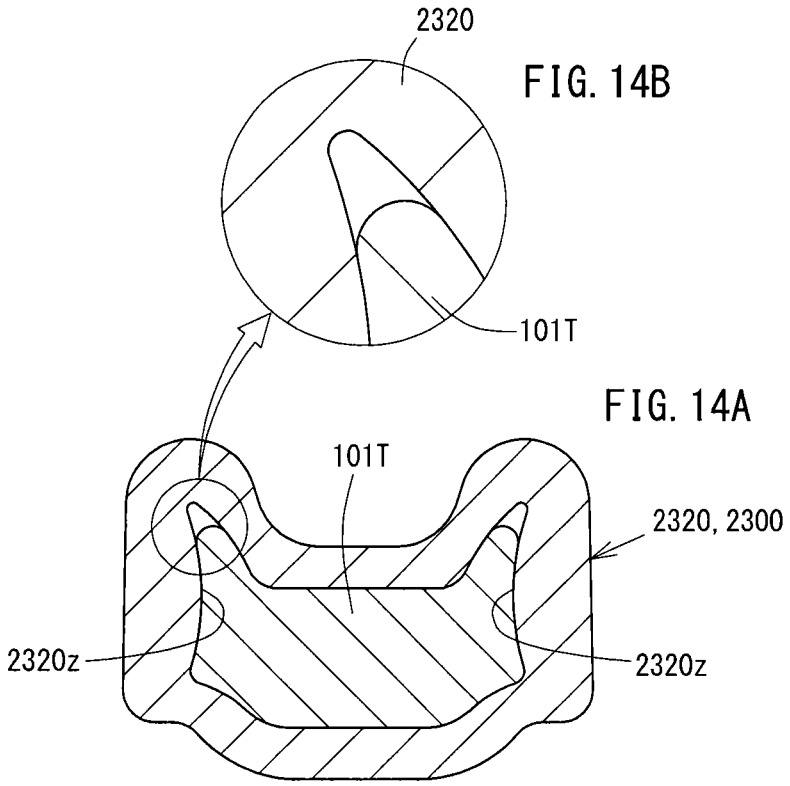
FIGS. 14A and 14B are cross-sectional views of a conductor pressure-bonding section of a conventional crimp terminal.

Accordingly, an extra large-wall-thickness portion is formed at the time of connecting the conventional conductor pressure-bonding section 2320 to the core wire tip 101T by pressure-bonding and, as shown in FIGS. 14A and 14B, a so-called inwardly-falling portion 2310*z* is formed where the extra large-wall-thickness portion projects and falls in the radially inward direction.

As described above, when the inwardly-falling portion 2310*z* is generated at the conductor pressure-bonding section 2320, at the time of connecting the conductor pressure-bonding section 2320 to the core wire tip 101T by pressure-bonding, the inwardly-falling portion 2310*z* serves as an obstacle. Accordingly, the aluminum core wire 101 does not reach corner portions of an inner space in the conductor pressure-bonding section 2320 so that there is a possibility that irregularity in electric characteristic is generated.

Figures 12A, 12B:
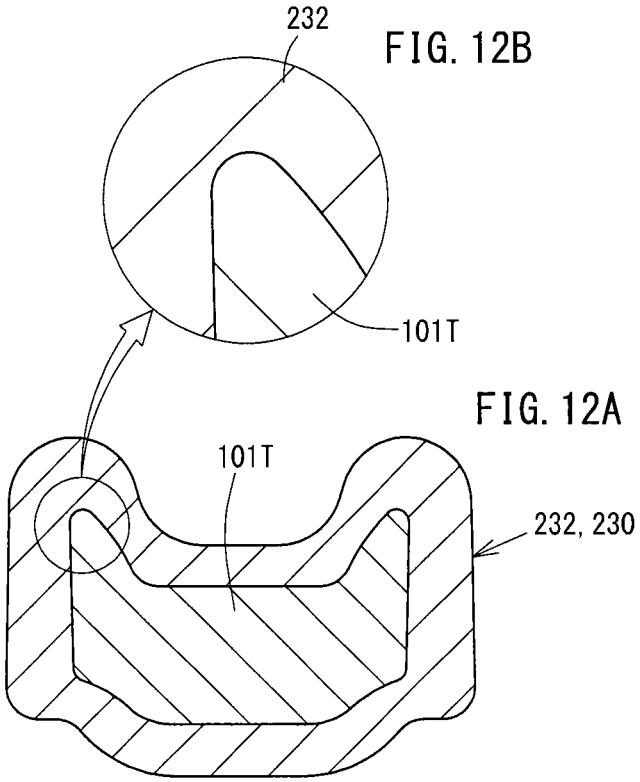
FIGS. 12A and 12B are explanatory views for describing a crimp terminal according to another embodiment.

In contrast, according to the barrel portion 230 of this embodiment which is formed into a stepped shape, compared to the above-mentioned barrel portion 2300 which is not formed into a stepped shape, a gap between the conductor pressure-bonding section 232 and the core wire tip 101T can be decreased in a state where the wire tip 100T is inserted into the barrel portion 230 as shown in FIGS. 12A and 12B.

Accordingly, even when the barrel portion 230 is connected to the core wire tip 101T by pressure-bonding, there is no possibility that the inwardly-falling portion 2310*z* having a shape difficult to be controlled at the time of pressure-bonding is generated at the conductor pressure-bonding section 232 so that the conductor pressure-bonding section 232 can be connected to the core wire tip 101T by pressure-bonding in a state where the conductor pressure-bonding section 232 and the core wire tip 101T are brought into close contact with each other whereby it is possible to prevent the generation of irregularity in electric characteristic thus acquiring excellent favorable electric characteristic.

Figure 13A:
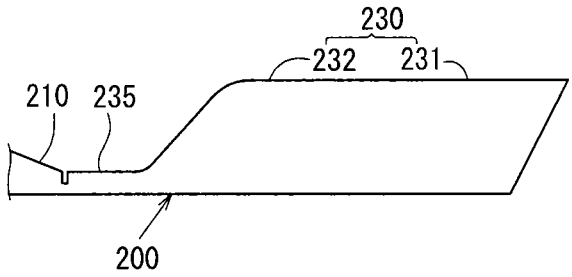
FIGS. 13A and 13B are explanatory views for describing a barrel portion of a crimp terminal according to another embodiment.
Figure 13A:
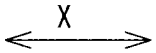

The barrel portion 230 may be formed such that a rear opening end portion is arranged in an inclined manner by taking into account the difference between a compression ratio of the conductor pressure-bonding section 232 and a compression ratio of the cover pressure-bonding section 231 in both of the case where the conductor pressure-bonding section 232 and the cover pressure-bonding section 231 are formed with diameters substantially equal to each other and the case where the barrel portion 230 is formed into a stepped shape while interposing the stepped portion 230*d* on a boundary portion between the conductor pressure-bonding section 232 and the cover pressure-bonding section 231. For example, as shown in FIG. 13A which is an explanatory view for describing a barrel portion 230 of another crimp terminal 200, the crimp terminal 200 may be formed such that an upper portion of an opening end portion of the barrel portion 230 is arranged in an inclined manner toward a rear side in a side view.

Figure 13B:
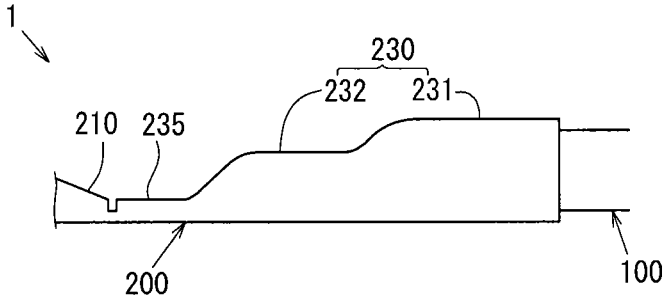

Due to such a constitution, the upper portion of the opening end portion is pulled frontward along with the pressure-bonding of the conductor pressure-bonding section 232 and hence, as shown in FIG. 13B, the opening end portion of the barrel portion 230 is arranged in a substantially vertical direction in a side view in a pressure-bonded state. Accordingly, the barrel portion 230 in a pressure-bonded state can pressure-bond the insulated wire 100 with a good-appearance pressure-bonded state.

The barrel portion 230 may be formed such that the rear opening end portion is arranged in a frontwardly or rearwardly inclined manner depending on a shape of a pressure-bonding blade die, and a deformation state of a wire pressure-bonding section 31 along with the pressure-bonding of the conductor pressure-bonding section 232 and the pressure-bonding of the cover pressure-bonding section 231 in such a manner that the opening end portion of the barrel portion 230 in a post-pressure-bonding state is arranged in a substantially vertical direction in a side view.

Further, the insulated wire 100 to be connected to the above-mentioned crimp terminal 200 is not limited to an insulated wire where an aluminum-based conductor made of aluminum or an aluminum alloy is covered with the insulating cover 102. For example, the insulated wire 100 may be an insulated wire where a copper-based conductor made of copper or a copper alloy is covered by the insulating cover 102, for example. Further, a conductor may be a composite conductor formed of different kinds of raw wires where aluminum raw wires are arranged around copper-based raw wires and are bound, or a composite conductor formed of different kinds of raw wires where copper-based raw wires are arranged around aluminum raw wires and are bound opposite to the composite conductor described above.

DESCRIPTION OF REFERENCE SIGNS

1: Pressure-bonding connection structural body
100: Insulated wire
101: Aluminum core wire
102: Insulating cover body
200: Crimp terminal
230: Barrel portion
230*a*: End portion
230*b*: Welded part
232: Conductor pressure-bonding section
232U: Conductor pressure-bonding section having a U-shape in a pressure-bonded state
234*a*: Upper surface concave shape
234T: Projecting portion
232X: Conductor pressure-bonding section having a cruciform shape in a pressure-bonded state
237*a*: Concave groove portion
237*b*: Projecting portion
232Y: Conductor pressure-bonding section having a Y-shape in a pressure-bonded state
238*a*: Concave groove portion
238*b*: Projecting portion
232H: Conductor pressure-bonding section having an H-shape in a pressure-bonded state
239*a*: Concave groove portion
239*b*: Projecting portion
X: Long length direction

The invention claimed is:

1. A crimp terminal provided with a pressure-bonding section which allows a pressure-bonding connection of at least a conductor tip of an insulated wire formed by covering a conductor with an insulating cover and having the conductor tip where the conductor is exposed by peeling off the insulating cover at least on a distal end side, wherein the pressure-bonding section is configured such that portions of a terminal base material in a terminal developed shape corresponding to the pressure-bonding section are formed into a cylindrical shape by bending the portions about a terminal axis, abutting end portions are formed by abutting the portions of the terminal base material corresponding to the pressure-bonding section, and a welded part where the abutting end portions are welded to each other is formed at least from a cover pressure-bonding section which pressure-bonds the insulating cover to a conductor pressure-bonding section which pressure-bonds the conductor along a long length direction of the pressure-bonding section, a portion of the pressure-bonding section where an amount of plastic deformation of the pressure-bonding section generated along with pressure-bonding of the pressure-bonding section applied to the conductor tip of the pressure-bonding section is relatively large compared to an amount of plastic deformation of a peripheral portion of the pressure-bonding section in a circumferential direction is set as a plastic deformation portion, and the welded part is formed in the plastic deformation portion.

2. The crimp terminal according to claim 1, wherein the pressure-bonding section is formed such that, on an orthogonal cross section which orthogonally intersects with the long length direction, both sides with respect to an imaginary axis of the pressure-bonding section are formed into a symmetrical shape, the imaginary axis which connects a center portion of the orthogonal cross section and the welded part linearly, and the plastic deformation portion is formed on both sides of the imaginary axis in the circumferential direction of the pressure-bonding section.

3. The crimp terminal according to claim 2, wherein the amount of plastic deformation of the pressure-bonding section is set to an amount of displacement that the pressure-bonding section is displaced along with the plastic deformation of the pressure-bonding section, and the plastic deformation portion where the welded part is formed is formed as a plastic displacement portion where the amount of displacement is large compared to an amount of displacement of the peripheral portion.

4. The crimp terminal according to claim 2, wherein the amount of plastic deformation of the pressure-bonding section is set to an amount of deformation by bending so that the pressure-bonding section is deformed by bending along with the plastic deformation of the pressure-bonding section, and the plastic deformation portion formed on the both sides of the imaginary axis in the circumferential direction of the pressure-bonding section is formed as a plastic bending deformation portion where the amount of deformation by bending is large compared to an amount of deformation by bending of the peripheral portion.

5. The crimp terminal according to claim 4, wherein the pressure-bonding section is formed such that the orthogonal cross section of the pressure-bonding section in a post-pressure-bonding state is formed into a U-shaped orthogonal cross section.

6. The crimp terminal according to claim 4, wherein the pressure-bonding section is formed such that the orthogonal cross section of the pressure-bonding section in a post-pressure-bonding state is formed into an H-shaped orthogonal cross section.

7. The crimp terminal according to claim 2, wherein the amount of plastic deformation of the pressure-bonding section is set to an amount of deformation by bending so that the pressure-bonding section is deformed by bending along with the plastic deformation of the pressure-bonding section, and the plastic deformation portion formed in the welded part is formed as a plastic bending deformation portion where the amount of deformation by bending is large compared to the amount of deformation by bending of the peripheral portion.

8. The crimp terminal according to claim 7, wherein the pressure-bonding section is formed such that the orthogonal cross section of the pressure-bonding section in a post-pressure-bonding state is formed into a cruciform-shaped orthogonal cross section having projecting portions on upper and lower sides as well as on left and right sides.

9. The crimp terminal according to claim 2, wherein the imaginary axis is set at an intermediate portion of the pressure-bonding section in a width direction.

10. A connection structural body where an insulated wire that is formed by covering a conductor with an insulating cover and has a conductor tip by exposing the conductor by peeling off the insulating cover on a distal end side by a predetermined length and a crimp terminal provided with a pressure-bonding section which allows a pressure-bonding connection of the conductor tip are connected to each other by pressure-bonding, wherein the crimp terminal is formed of the crimp terminal described in claim 1, and the pressure-bonding section and at least the conductor tip of the insulated wire are pressure-bonded to each other.

11. A wire harness comprising:

a plurality of pressure-bonding connection structural bodies described in claim 10, and a connector housing configured to house the crimp terminals of the connection structural bodies, wherein the crimp terminals are disposed in the inside of the connector housing.

12. A method of manufacturing a connection structural body comprising:

forming a crimp terminal provided with a cylindrical pressure-bonding section by a method of manufacturing the crimp terminal, the method of manufacturing the crimp terminal comprising:

forming a terminal base material by blanking a base material in a terminal developed shape;

forming the terminal base material into a cylindrical shape by bending portions of the terminal base material corresponding to the pressure-bonding section about a terminal axis; and forming a welded part at least from a cover pressure-bonding section which pressure-bonds the insulating cover to a conductor pressure-bonding section which pressure-bonds the conductor along a long length direction, the welded part to weld adjacent end portions where the portions of the terminal base material corresponding to the pressure-bonding section are adjacent to each other in a circumferential direction, in this order;

the method of manufacturing the connection structural body further comprising:

inserting at least a conductor tip into the pressure-bonding section in a pre-pressure-bonding state, the conductor tip formed by exposing a conductor by a predetermined length on a distal end side by peeling off an insulated cover of an insulating wire formed by covering the conductor with the insulating cover; and pressure-bonding the pressure-bonding section to at least the conductor tip, the inserting at least the conductor tip and the pressure-bonding performed in this order, thus connecting the crimp terminal and the insulated wire to each other by pressure-bonding, wherein in the forming the terminal base material into the cylindrical shape, bending is applied to the portions of the terminal base material corresponding to the pressure-bonding section such that the adjacent end portions of the portions of the terminal base material corresponding to the pressure-bonding section are arranged at a plastic deformation portion where an amount of plastic deformation that the pressure-bonding section is plastically deformed along with the pressure-bonding of the pressure-bonding section to the conductor tip in the pressure-bonding is large compared to other portions of the pressure-bonding section in the circumferential direction.

13. The method of manufacturing a connection structural body according to claim 12, wherein welding of the adjacent end portions in the forming the welded part is performed by fiber laser welding.

14. The method of manufacturing a connection structural body according to claim 12, wherein the pressure-bonding section is comprised of the conductor pressure-bonding section which pressure-bonds the conductor tip, and the cover pressure-bonding section which pressure-bonds a cover tip arranged on a more proximal end side than the conductor tip on a wire distal end side, and the conductor pressure-bonding section and the cover pressure-bonding section are simultaneously pressure-bonded in the pressure-bonding.

15. The crimp terminal according to claim 1, wherein the welded part extends continuously from the cover pressure-bonding section which pressure-bonds the insulating cover to the conductor pressure-bonding section which pressure-bonds the conductor.

16. The crimp terminal according to claim 1, wherein the pressure-bonding section is comprised of the conductor pressure-bonding section which pressure-bonds the conductor tip, and the cover pressure-bonding section which pressure-bonds a cover tip arranged on a more proximal end side than the conductor tip on a wire distal end side.

17. The crimp terminal according to claim 1, wherein an outer surface of the welded part is flush with adjacent outer surfaces of the cover pressure-bonding section.

* * * * *